US008479471B2

(12) United States Patent
Liberman

(10) Patent No.: US 8,479,471 B2
(45) Date of Patent: Jul. 9, 2013

(54) MODULAR BUILDING STRUCTURES

(76) Inventor: Barnet L. Liberman, New York, NY (US)

( * ) Notice: Subject to any disclaimer, the term of this patent is extended or adjusted under 35 U.S.C. 154(b) by 914 days.

(21) Appl. No.: 12/080,105

(22) Filed: Apr. 1, 2008

(65) Prior Publication Data

US 2008/0236090 A1 Oct. 2, 2008

Related U.S. Application Data

(60) Provisional application No. 60/921,405, filed on Apr. 2, 2007, provisional application No. 60/921,413, filed on Apr. 2, 2007.

(51) Int. Cl.
*E04B 1/00* (2006.01)

(52) U.S. Cl.
USPC ..... 52/741.1; 52/742.16

(58) Field of Classification Search
USPC ..... 52/125.4, 514, 514.5, 583.1, 741.1, 52/742.1, 742.13, 742.14, 742.15, 742.16
See application file for complete search history.

(56) References Cited

U.S. PATENT DOCUMENTS

| | | | | |
|---|---|---|---|---|
| 1,960,575 | A | 5/1934 | Davison | |
| 2,543,692 | A | 2/1951 | Glover | |
| 2,592,634 | A * | 4/1952 | Wilson | 52/584.1 |
| 2,920,475 | A * | 1/1960 | Graham | 52/432 |
| 3,369,334 | A * | 2/1968 | Berg | 52/223.13 |
| 3,372,519 | A | 3/1968 | Russell | |
| 3,831,332 | A | 8/1974 | Weese | |
| 4,558,797 | A | 12/1985 | Mitchell | |
| 4,907,660 | A | 3/1990 | Staggs et al. | |
| 5,216,860 | A | 6/1993 | Thomson et al. | |
| 5,267,419 | A | 12/1993 | Yokota et al. | |
| 5,366,672 | A * | 11/1994 | Albrigo et al. | 264/35 |
| 5,586,834 | A * | 12/1996 | Tsuji | 404/60 |
| 5,596,853 | A | 1/1997 | Blaney et al. | |
| 6,065,263 | A * | 5/2000 | Taguchi | 52/583.1 |
| 6,074,101 | A | 6/2000 | Bloom | |
| 6,195,955 | B1 * | 3/2001 | Kostopoulos | 52/741.13 |

(Continued)

FOREIGN PATENT DOCUMENTS

EP 1 857 602 A2 11/2007

OTHER PUBLICATIONS

Search Report and Written Opinion dated Dec. 10, 2008 issued for underlying International PCT Application PCT/US2008/011295.

(Continued)

*Primary Examiner* — William Gilbert
*Assistant Examiner* — Theodore Adamos
(74) *Attorney, Agent, or Firm* — Cozen O'Connor

(57) ABSTRACT

Presented are methods of assembling and disassembling a modular unit so that the modular unit. The modular unit includes at least a concrete column with an embedded steel receptacle and an access port, and a concrete joist/slab with an embedded steel receptacle and an access port. The methods include inserting a first end of the rigid member into the steel receptacle of the joist/slab and a second end of the rigid member into the steel receptacle of the column to form the modular unit. The first and second ends of the rigid member are releasably coupled to the steel receptacles of the joist/slab and column, respectively. The first and second ends of the rigid member are then decoupled from the steel receptacles of the joist/slab and column, respectively. The joist/slab, column, and rigid member are separated so that at least joist/slab and column can be reused and/or recycled.

4 Claims, 23 Drawing Sheets

U.S. PATENT DOCUMENTS

| | | | | |
|---|---|---|---|---|
| 6,237,297 | B1 | 5/2001 | Paroly | |
| 6,327,829 | B1 * | 12/2001 | Taguchi | 52/583.1 |
| 6,367,214 | B1 * | 4/2002 | Monachino | 52/247 |
| 6,588,296 | B2 | 7/2003 | Wessel | |
| 6,978,572 | B1 | 12/2005 | Bernklau et al. | |
| 7,033,116 | B1 * | 4/2006 | Ward et al. | 405/229 |
| 2005/0044809 | A1 * | 3/2005 | Thompson | 52/583.1 |
| 2005/0241918 | A1 | 11/2005 | Alldredge et al. | |

OTHER PUBLICATIONS

International Preliminary Report on Patentability ("IPRP"), dated Oct. 15, 2009 issued for the priority International PCT Application PCT/US2008/004290.

Search Report dated Jul. 2, 2008 issued for the underlying International PCT Application PCT/US08/042290 (14 pages).

* cited by examiner

MODULAR BUILDING STRUCTURES

CROSS-REFERENCE TO RELATED APPLICATIONS

This application claims priority to, and the benefit of, provisional U.S. Patent Application Ser. No. 60/921,405, filed Apr. 2, 2007, and provisional U.S. Patent Application Ser. No. 60/921,413, filed Apr. 2, 2007, the entirety of which are incorporated herein by reference.

1. Field of the Invention

The present invention relates generally to modular building structures, and more particularly to various modular components and methods for assembling and disassembling the various modular components to construct modular building structures.

2. Description of the Related Art

Modular units are commonly used for constructing residential and industrial structures because they can be partially assembled/constructed at a factory and transported via train, truck, or ship to a construction site for assembly into a complete structure. However, once the modular units are assembled into complete structures, existing methods of assembly do not allow for easy disassembly so that the modular units can be segregated into components and/or reused for constructing new structures when the original structure is no longer needed, such as a temporary office annex. Consequently, many otherwise sound modular units are wasted because they cannot be disassembled without being damaged or destroyed.

SUMMARY OF THE INVENTION

In one aspect, the invention involves a method of assembling and disassembling a modular unit. The modular unit includes at least a concrete column that includes an embedded steel receptacle and a concrete joist/slab that includes an embedded steel receptacle. The method includes inserting a first end of a rigid member in the receptacle embedded in the joist/slab, inserting a second end of the rigid member into the receptacle embedded in the column so that the column and the joist/slab contact each other, and releasably coupling the first end of the rigid member to the receptacle embedded in the joist/slab. The method further includes releasably coupling the second end of the rigid member to the receptacle embedded in the column and thereby form the modular unit, decoupling the first end of the rigid member from the receptacle embedded in the joist/slab, decoupling the second end of the rigid member from the receptacle embedded in the column, and separating the column, the joist/slab, and the rigid member apart from each other for at least one of reuse and recycling.

In another aspect, the invention involves a method of assembling and disassembling a modular unit. The modular unit includes at least a concrete column that includes an embedded steel receptacle and an access port providing access to the interior of the receptacle, and a concrete joist/slab that includes an embedded steel receptacle and an access port providing access to the interior of the receptacle. The method includes providing a rod having an outer diameter equal to an inner diameter of the receptacle embedded in the column and an inner diameter of the receptacle embedded in the joist/slab, applying a cooling agent to the rod to cause the outer diameter of the rod to decrease to a diameter that is less than the inner diameter of the receptacle embedded in the column and the inner diameter of the receptacle embedded in the joist/slab, and inserting one end of the rod into the receptacle embedded in the joist/slab. The method further includes inserting the other end of the rod into the receptacle embedded in the column so that the column and the joist/slab contact each other, and allowing the rod to heat to the ambient temperature so that the outer diameter increases to be equal to the inner diameter of the receptacle embedded in the column and the inner diameter of the receptacle embedded in the joist/slab and thereby create a friction fit with the receptacle embedded in the joist/slab and the receptacle embedded in the column, and thereby form the modular unit. The method further includes introducing the cooling agent into the access port in the column and the access port of the joist/slab so that the cooling agent contacts the rod to cool the rod to cause the outer diameter of the rod to decrease to a diameter that is less than the inner diameter of the receptacle embedded in the column and the inner diameter of the receptacle embedded in the joist/slab, and separating the column, the joist/slab, and the rod apart from each other for at least one of reuse and recycling.

In one embodiment, the rod includes a material with a coefficient of expansion different from the coefficient of expansion of the receptacle embedded in the column and the receptacle embedded in the joist/slab. In another embodiment, the cooling agent includes liquid nitrogen.

In still another aspect, the invention involves a method of assembling and disassembling a modular unit. The modular unit includes at least a concrete column that includes an embedded steel receptacle and an access port providing access to the interior of the receptacle, and a concrete joist/slab that includes an embedded steel receptacle and an access port providing access to the interior of the receptacle. The method includes providing a wooden rod having an outer diameter equal to or less than an inner diameter of the receptacle embedded in the column and an inner diameter of the receptacle embedded in the joist/slab, inserting one end of the wooden rod in the receptacle embedded in the joist/slab and thereby create a friction fit with the receptacle embedded in the joist/slab, inserting the other end of the wooden rod into the receptacle embedded in the column so that the column and the joist/slab contact each other to form the modular unit, the wooden rod and the receptacle embedded in the column creating a friction fit, introducing a means for dissolving or destroying the wooden rod into the access port in the column and the access port of the joist/slab, and separating the column and the joist/slab apart from each other for at least one of reuse and recycling.

In one embodiment, the wooden rod includes a plurality of laminated plywood layers glued together. In other embodiments, the means for dissolving or destroying the wooden rod includes a solvent or termites or other wood damaging insects. In another embodiment, the method includes disposing a screen over the access port in the column and the access port in the joist/slab after introduction of the termites or other wood damaging insects.

In yet another aspect, the invention involves a method of assembling and disassembling a modular unit. The modular unit includes at least a concrete column that includes an embedded steel receptacle, and a concrete joist/slab that includes an embedded steel receptacle. The method includes providing a plurality of steel rods each having an outer diameter less than an inner diameter of the receptacle embedded in the column and an inner diameter of the receptacle embedded in the joist/slab, inserting one end of each of the plurality of steel rods into the receptacle embedded in the joist/slab and thereby create a friction fit with the receptacle embedded in the joist/slab, inserting the other end of each of the plurality of steel rods into the receptacle embedded in the column so that the column and the joist/slab contact each other to form the modular unit, the plurality of steel rods and the receptacle embedded in the column creating a friction fit, and prying the column, the joist/slab, and the plurality of steel rods apart from each other for at least one of reuse and recycling.

In one embodiment, the prying step includes inserting a pry bar into pry bar slots disposed in the column.

According to another aspect, the invention involves a method of assembling and disassembling a modular unit. The modular unit includes at least a concrete column that includes an embedded steel receptacle, a locking gear mechanism disposed in the steel receptacle, and an access port providing access to the locking gear mechanism, and a concrete joist/slab that includes an embedded steel receptacle, a locking gear mechanism disposed in the steel receptacle, and an access port providing access to the locking gear mechanism. The method includes providing a steel rod having an outer diameter less than an inner diameter of the receptacle embedded in the column and an inner diameter of the receptacle embedded in the joist/slab, the steel rod having at least two notches disposed at a proximal end and diametrically opposite each other and spaced at different distances from the proximal end and at least two notches disposed at a distal end and diametrically opposite each other and spaced at different distances from the distal end, inserting the proximal end of the steel rod into the receptacle embedded in the joist/slab so that the notches in the proximal end of the steel rod are proximate to the gear mechanism disposed in the receptacle of joist/slab, and actuating the locking gear mechanism disposed in the receptacle of joist/slab to engage the notches in the proximal end of the steel rod and thereby lock the proximal end of the steel rod in place. The method further includes inserting the distal end of the steel rod into the receptacle embedded in the column so that the notches in the distal end of the steel rod are proximate to the gear mechanism disposed in the receptacle of column, and the column and the joist/slab contact each other, and actuating the locking gear mechanism disposed in the receptacle of column to engage the notches in the distal end of the steel rod and thereby lock the distal end of the steel rod in place and thereby form the modular unit. The method further includes actuating the locking gear mechanism disposed in the receptacle of joist/slab to disengage the notches in the proximal end of the steel rod and thereby release the proximal end of the steel rod, actuating the locking gear mechanism disposed in the receptacle of column to disengage the notches in the distal end of the steel rod and thereby release distal end of the steel rod, and separating the column, the joist/slab, and the steel rod apart from each other for at least one of reuse and recycling.

In one embodiment, the locking gear mechanism disposed in the steel receptacle of the joist/slab and the locking gear mechanism disposed in the steel receptacle of the column each comprise two steel plates, each of the steel plates defining an opening. In another embodiment, actuating the locking gear mechanism disposed in the steel receptacle of the joist/slab and the locking gear mechanism disposed in the steel receptacle of the column includes causing each of the openings to engage one of the notches disposed on the steel bar.

In still another aspect, the invention involves a method of assembling and disassembling a modular unit. The modular unit includes at least a concrete column that includes an embedded steel receptacle, a first steel plate integrated with the steel receptacle, and an access port providing access to the first steel plate, and a concrete joist/slab that includes an embedded steel receptacle, a second steel plate integrated with the steel receptacle, and an access port providing access to the second steel plate. The method includes providing a third steel plate configured to couple with the first and second steel plates, inserting a proximal end of the steel plate into the receptacle embedded in the joist/slab to contact and align with the second steel plate, coupling the third steel plate to second steel plate, and inserting a distal end of the steel plate into the receptacle embedded in the column so that the distal end of the third steel plate and the first steel plate contact and align with each other and the column and the joist/slab contact each other. The method further includes coupling the third steel plate to first steel plate and thereby form the modular unit, decoupling the third steel plate and second steel plate, decoupling the third steel plate and first steel plate, and separating the column, the joist/slab, and the third steel plate apart from each other for at least one of reuse and recycling.

In one embodiment, the third steel plate is coupled to the second steel plate using a threaded bolt inserted through the access port in the joist/slab, and the third steel plate is coupled to the first steel plate using a threaded bolt inserted through the access port in the column.

In yet another aspect, the invention involves a method of assembling and disassembling a modular unit. The modular unit includes at least a concrete column that includes an embedded steel receptacle having an opening at a proximal end and an opening at a distal end, and a concrete joist/slab that includes an embedded steel receptacle having an opening at a proximal end. the method includes disposing the column on top of the joist slab such that the proximal opening of the receptacle of the joist/slab and the distal opening of the receptacle of the column meet and the receptacle of the column and the receptacle of the joist/slab are aligned along the same longitudinal axis, inserting a threaded steel rod into the receptacle of the column and the receptacle of the joist/slab so that the threaded steel rod extends from the receptacle of the joist/slab through the proximal opening in the receptacle of the joist/slab and through the distal opening of the receptacle of the column and extends out of the proximal opening of the receptacle of the column, the threaded rod having an outer diameter less than an inner diameter of the receptacle of the joist/slab and the receptacle of the column, the threaded rod having a notch disposed in a proximal end, and disposing grout in the receptacle of the joist/slab and the receptacle of the column to surround and secure the threaded steel rod and thereby form the modular unit. The method further includes engaging a twisting means with the notch in the proximal end of the threaded steel rod, actuating the twisting means to apply torque to the threaded rod to thereby break up the grout, and separating the column, the joist/slab, and the threaded steel rod apart from each other for at least one of reuse and recycling.

In one embodiment, the threaded steel rod is wrapped in a sheath. In another embodiment, the twisting means includes a steel bar or an impact hammer drive.

In another aspect, the invention involves a method of assembling and disassembling a modular unit. The modular unit includes at least a concrete column that includes an embedded steel receptacle having an opening at a distal end and an access port providing access to the interior of the receptacle, and a concrete joist/slab that includes an embedded steel receptacle having an opening at a proximal end. The method includes inserting a first threaded steel rod into the receptacle of the column, the first threaded steel rod comprising a coupling device disposed at a distal end of the first threaded steel rod and proximate to the distal opening of the receptacle of the column, the first thread steel rod having a length shorter than the length of the receptacle of the column, disposing grout in the receptacle of the column to surround at least a portion of the first threaded steel rod and secure the first threaded steel rod, inserting a second threaded steel rod into the receptacle of the joist/slab, the second threaded steel rod having a length longer than the length of the receptacle of the joist/slab such that a portion of the second threaded steel rod extends out of the proximal opening of the receptacle of the joist/slab, and disposing grout in the receptacle of the joist/slab to surround at least a portion of the second threaded steel rod and secure the second threaded steel rod. The method further includes inserting the portion of the second threaded steel rod that extends out of the proximal opening of the receptacle of the joist/slab into the distal end of the receptacle of the column so that second threaded steel rod contacts the first threaded steel road and the column contacts the joint/slab, actuating the coupling device through the access port to couple the first and second steel rods and thereby form the modular structure, actuating the coupling device through the access port to decouple the first and second steel rods, and separating the column and the joist/slab apart from each other for at least one of reuse and recycling.

In some embodiments, the coupling device comprises a threaded hex coupler or a slip connector.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, like reference characters refer to the same parts throughout the different views. Also, the drawings are not necessarily to scale, emphasis instead generally being placed upon illustrating the principles of the invention.

DETAILED DESCRIPTION OF THE PRESENTLY PREFERRED EMBODIMENTS

The present invention involves various modular components and methods for assembling and disassembling the various modular components to construct reusable modular building structures.

Figure 1A:
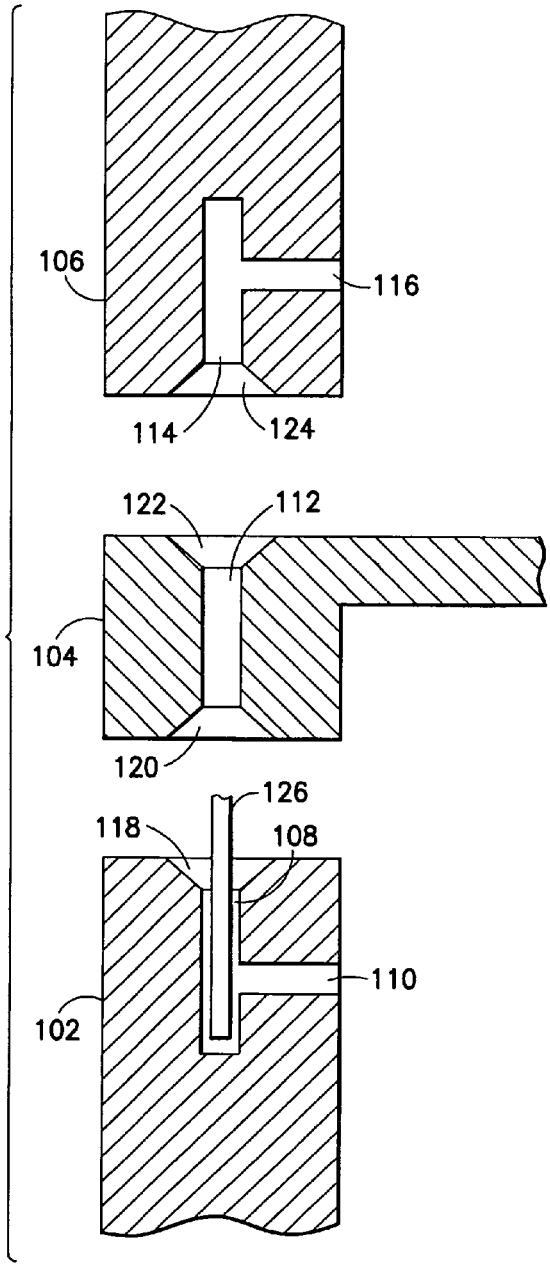
FIG. 1A is an illustrative cross-sectional side view of an upper column, a joist, and a lower column prior to assembly using a steel rod, according to one embodiment of the invention.
Figure 1B:
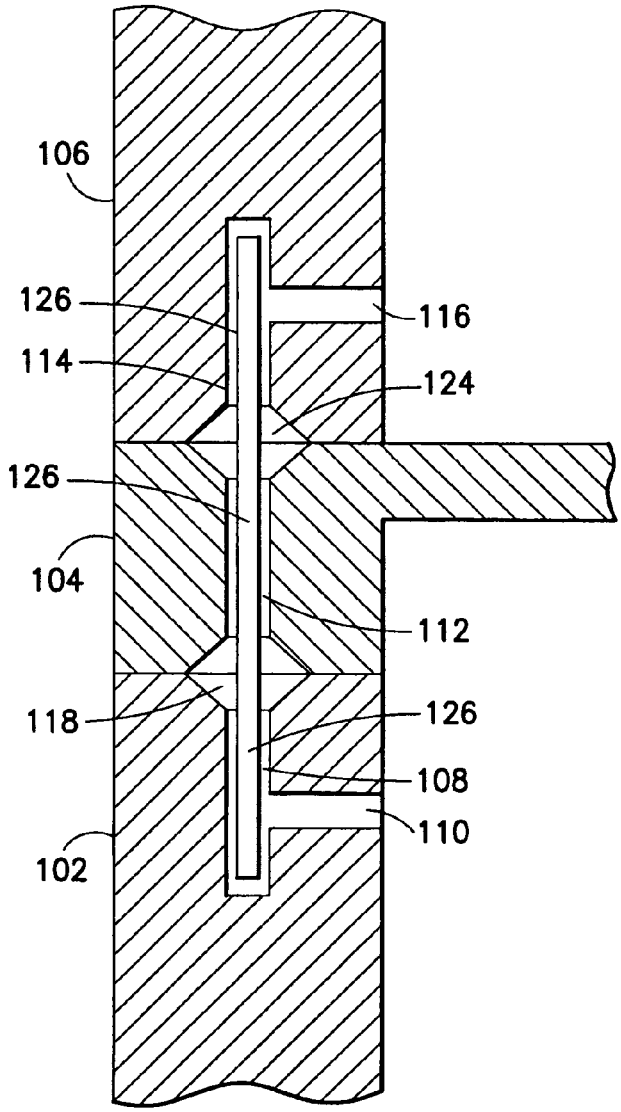
FIG. 1B is an cross-sectional illustrative side view of an upper column, a joist, and a lower column assembly with a steel rod disposed in steel receptacles disposed in the upper and lower columns, according to one embodiment of the invention.

Referring to FIGS. 1A and 1B, in one embodiment, an upper column 106, a joist and slab 104, and a lower column 102 prior to assembly is shown. In this embodiment, the upper column 106 and the lower column 102 are made of concrete and each have a steel tube/receptacle 114, 108 respectively embedded therein. The receptacle 114 includes a widened opening 124 and the receptacle 108 includes a widened opening 118. Further, the upper column 106 and the lower column 102 each include an access port 116, 110, respectively. The access ports 116, 110 allow access to the interior of the steel receptacles 114 and 108. The joist 104 includes a through hole 112 with widened openings 120 and 122 at each end.

To assemble the upper column 106, the joist 104, and the lower column 102, a steel rod or tube 126, which has an outer diameter that is equal to the inner diameters of the receptacles 114 and 108, is first cooled with liquid nitrogen or other cooling method to lower the temperature of the steel rod 126 enough to shrink the diameter of the steel rod 126 so that its outer diameter is now less than the inner diameter of the receptacles 114 and 108. The steel rod 126 is then inserted into the receptacle 108 of the lower column 102. The widened opening 118 allows easy insertion of the steel rod 126 into the receptacle 108. The steel rod 126 can also have tapered ends to further facilitate easy insertion into the receptacle 108 (and receptacle 114).

The joist 104 is then lowered over and aligned with the lower column 102 so that the steel rod 126 can pass through the through hole 112, which has an inner diameter greater than the steel rod 126. The widened opening 120 allows easy insertion of the steel rod 126 into the through hole 112. The joist 104 is then lowered and placed on top of the lower column 102.

Once the joist 104 is in place on top of the lower column 102, the upper column 106 is then lowered over and aligned with the joist 104 so that the steel rod 126 can be inserted into the receptacle 114. The widened opening 124 allows easy insertion of the steel rod 126 into the receptacle 114. The upper column 106 is then lowered and placed on top of the joist 102, and the steel rod 126 slides into the receptacle 114.

When the steel rod 126 heats up to the ambient temperature, the diameter of the steel rod 126 increases to its original outer diameter, which is the same as the inner diameters of the receptacles 114 and 108, and thereby creates a friction fit with the receptacles 114 and 108. The result is a rigid structure that includes the upper column 106, the joist/slab 104 and the lower column 102 held in place by the steel rod 126. This process is repeated to construct a frame for a modular unit. The access ports 110 and 116 are covered/sealed with a fireproof plug when not being used to insert liquid nitrogen.

In other embodiments, to protect the steel rod 126 and the receptacles 114 and 108 from rusting together, the outer surface of the steel rod 126 or the inner surface of the receptacles 114 and 108 can be coated with a material such as polytetrafluoroethylene or plastic, for example.

To disassemble the structure, liquid nitrogen is pumped into the access ports 110 and 116, flows into the receptacles 114 and 108, and contacts the steel rod 126. The liquid nitrogen again causes the outer diameter of the steel rod 126 to decrease and become less than the inner diameters of the receptacles 114 and 108, and thereby allows the upper column 106, the joist 104, the lower column 102, and the steel rod 126 to be easily separated and reused.

In another embodiment, the upper column 106 and the joist/slab 104 can be cast in to one piece. A steel receptacle would then be embedded in the bottom of the joist. The lower column 102 can be connected to the upper column/joist slab piece using the method described above.

In still another embodiment, the rod 126 can be made of a different material or alloy that has a different coefficient of expansion than the receptacles 114 and 108. This would enable a greater contraction and expansion of the rod 126 with a temperature variation as compared to the receptacles 114 and 108.

Figure 2A:
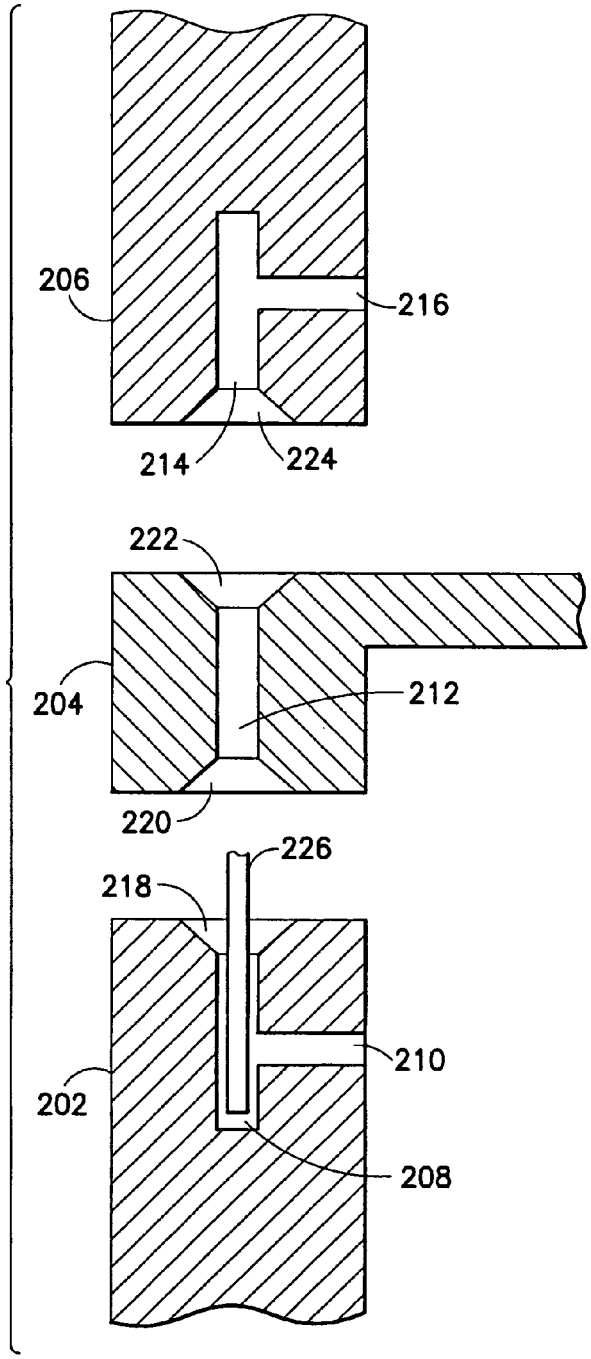
FIG. 2A is an cross-sectional illustrative side view of an upper column, a joist, and a lower column prior to assembly using a wooden rod, according to one embodiment of the invention.
Figure 2B:
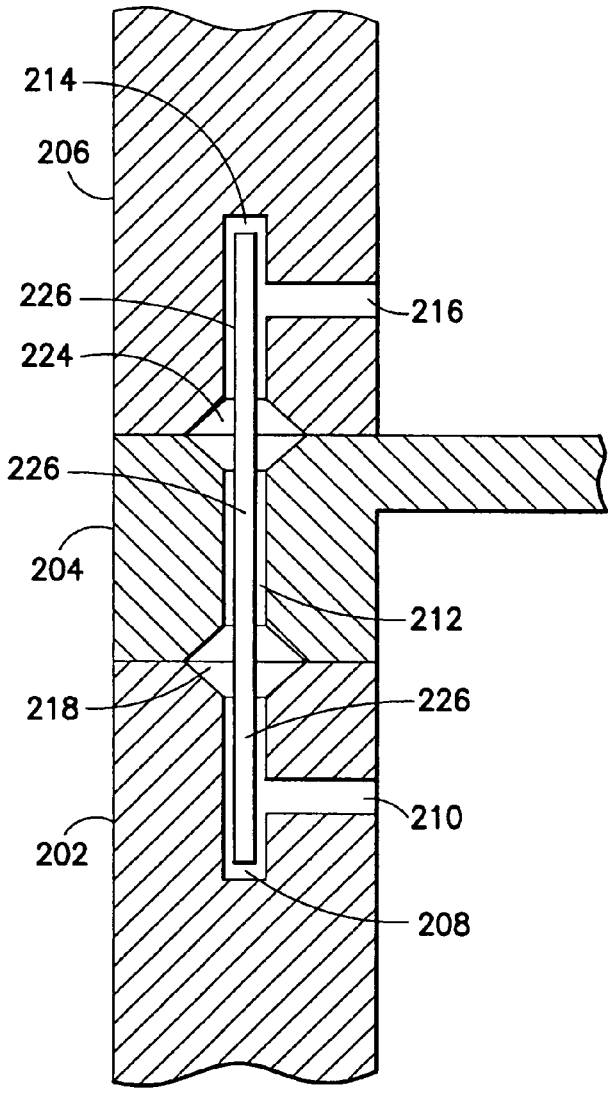
FIG. 2B is an cross-sectional illustrative side view of an upper column, a joist, and a lower column assembly with a wooden rod disposed in steel receptacles disposed in the upper and lower columns, according to one embodiment of the invention.

Referring to FIGS. 2A and 2B, in one embodiment, an upper column 206, a joist and slab 204, and a lower column 102 prior to assembly is shown. In this embodiment, the upper column 206 and the lower column 202 are made of concrete and each has a steel tube/receptacle 214, 208 respectively embedded therein. The receptacle 214 includes a widened opening 224 and the receptacle 208 includes a widened opening 218. Further, the upper column 206 and the lower column 202 each include an access port 216, 210, respectively. The access ports 216, 210 allow access to the interior of the steel receptacles 214 and 208. The joist 204 includes a through hole 212 with widened openings 220 and 222 at each end.

Figure 2C:
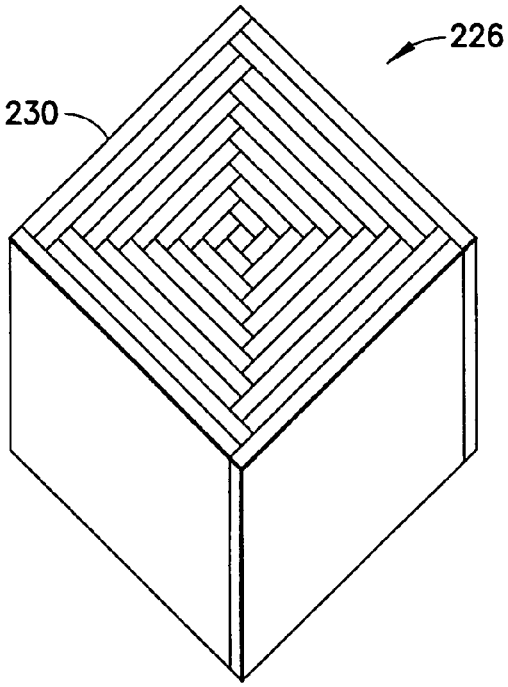
FIG. 2C is an illustrative cross-sectional perspective view of a portion of a wooden bar, according to one embodiment of the invention.

To assemble the upper column 206, the joist 204, and the lower column 202, a wooden rod or beam 226, which has an outer diameter that is equal to or slightly less the inner diameters of the receptacles 214 and 208, is first inserted into the opening 218 and forced into the receptacle 208 of the lower column 202 creating a friction fit with the receptacle 208. The wooden rod or beam 226 can also have tapered ends to further facilitate easy insertion into the receptacle 208 (and receptacle 214). The wooden rod or beam 226 is made of layered laminated plywood strips glued together as shown in FIG. 2C. In the case of a rod, the beam shown in FIG. 2C could be sanded or milled to the shape of a rod.

The joist 204 is then lowered over and aligned with the lower column 202 so that the wooden rod 226 can pass through the through hole 212, which has an inner diameter greater than the outer diameter of the rod/beam 226. The widened opening 220 allows easy insertion of the wooden rod 226 into the through hole 212. The joist 204 is then lowered and placed on top of the lower column 202.

Once the joist 204 is in place on top of the lower column 202, the upper column 206 is then lowered over and aligned with the joist 204 so that the wooden rod 226 can be inserted into the receptacle 214. The widened opening 224 allows easy insertion of the wooden rod 226 into the receptacle 214. The upper column 206 is then lowered and placed on top of the joist 202, and the wooden rod/beam 226 slides into the receptacle 214. The weight of the upper column 206 is such that the wooden rod/beam 226 is forced into the receptacle 214 creating a friction fit with the receptacle 214. The result is a rigid structure that includes the upper column 206, the joist/slab 204 and the lower column 202 held in place by the wooden rod/beam 226. This process is repeated to construct a frame for a modular unit. The access ports 210 and 216 are covered/sealed with a fireproof plug.

To disassemble the structure, in one embodiment, termites, or other wood damaging insects, are introduced into the access ports 210 and 216. After the termites are introduced in the access ports 210 and 216, the access ports 210 and 216 are each covered with a screen to prevent the termites from escaping, while allowing air into the access ports 210 and 216. The termites make their way through the access ports 210 and 216 to the receptacles 208 and 214 to access the wooden rod/beam 226. After a period of time, the termites then consume enough of the wood rod/beam 226 to allow the upper column 206, the joist 204, and the lower column 202 to be easily separated and reused. The wooden rod/beam 226 is not reusable.

In another embodiment, a wood solvent is pumped into the access ports 210 and 216, flows into the receptacles 214 and 208, and contacts the wooden rod/beam 226. The wood solvent dissolves, at least partially, the wooden rod/beam 226 and thereby allows the upper column 206, the joist 204, and the lower column 202 to be easily separated and reused.

In another embodiment, the upper column 206 and the joist/slab 204 can be cast in to one piece. A steel receptacle would then be embedded in the bottom of the joist. The lower column 202 can be connected to the upper column/joist slab piece using the method described above.

Figure 3A:
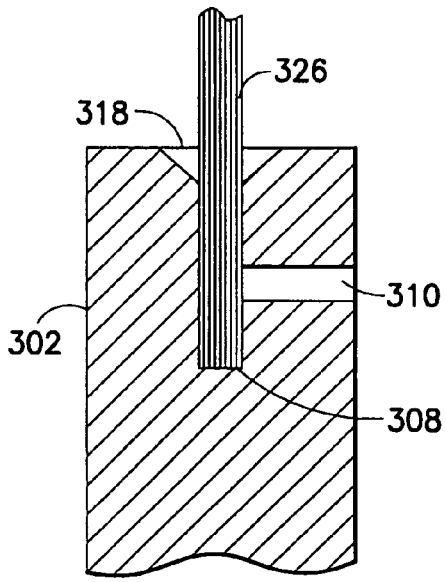
FIG. 3A is an illustrative cross-sectional side view of a plurality of metal rods inserted into a steel receptacle embedded in a column, according to one embodiment of the invention.
Figure 3B:
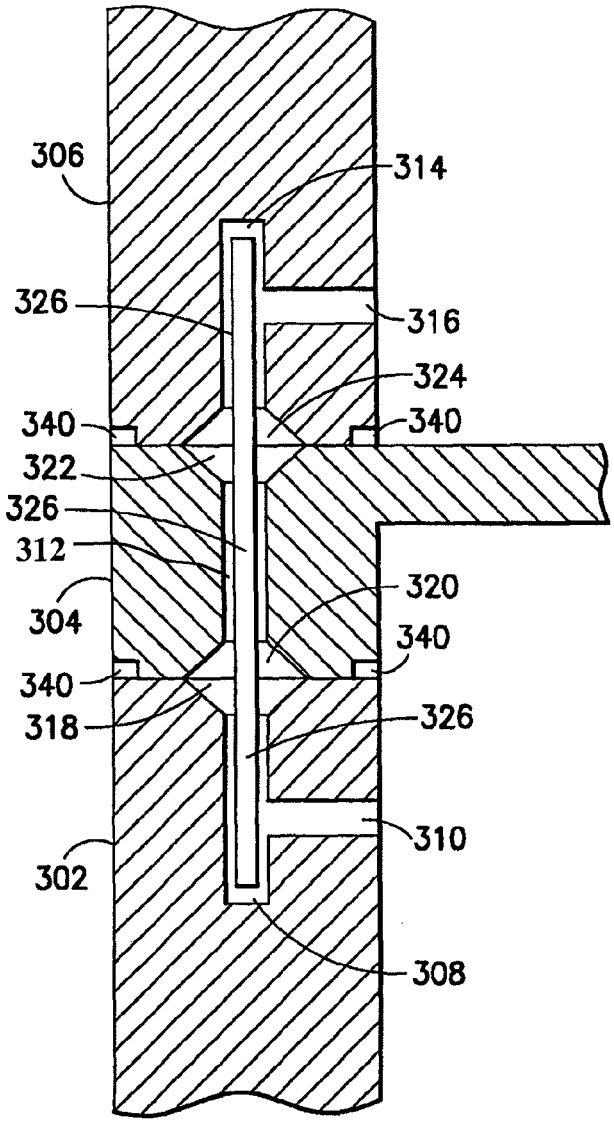
FIG. 3B is an illustrative cross-sectional side view of an upper column, a joist, and a lower column assembly with a plurality of steel rods disposed in steel receptacles disposed in the upper and lower columns, according to one embodiment of the invention.

Referring to FIGS. 3A and 3B, in one embodiment, an upper column 306, a joist and slab 304, and a lower column 302 are shown. In this embodiment, the upper column 306 and the lower column 302 are made of concrete and each has a steel tube/receptacle 314, 308 respectively embedded therein. The receptacle 314 includes a widened opening 324 and the receptacle 308 includes a widened opening 318. Further, the upper column 306 and the lower column 302 each may include an access port 316, 310, respectively. The access ports 316, 310 allow access to the interior of the steel receptacles 314 and 308. The joist 304 includes a through hole 312 with widened openings 320 and 322 at each end.

To assemble the upper column 306, the joist/slab 304, and the lower column 302, a plurality of thin steel rods 326 are first inserted into the opening 318 and forced into the receptacle 308 of the lower column 302 creating a friction fit with the receptacle 308. Each of the plurality of steel rods 326 can also have tapered ends to further facilitate easy insertion into the receptacle 308 (and receptacle 314). Each of the plurality of steel rods 326 has an outer diameter much smaller than the inner diameter of the receptacle 308. Consequently, a plurality of the steel rods 326 having various diameters are required to fill the receptacle 308. Individual steel rods 326 are therefore placed into the receptacle 308 until there is almost no room left in the receptacle 308. A final thin steel rod of an appropriate diameter is then forced into the space remaining in the receptacle 308 to create a friction fit with the receptacle 308.

The joist 304 is then lowered over and aligned with the lower column 302 so that the steel rods 326 can pass through the through hole 312. The widened opening 320 allows easy insertion of the steel rods 326 into the through hole 312. The joist 304 is then lowered and placed on top of the lower column 302.

Once the joist 304 is in place on top of the lower column 302, the upper column 306 is then lowered over and aligned with the joist 304 so that the steel rods 326 can be inserted into the receptacle 314. The widened opening 324 allows easy insertion of the steel rods 326 into the receptacle 314. The upper column 306 is then lowered and placed on top of the joist 302, and the steel rods 326 slide into the receptacle 314. The weight of the upper column 306 is such that the steel rods 326 are forced into the receptacle 314 creating a friction fit with the receptacle 314. The result is a rigid structure that includes the upper column 306, the joist/slab 304 and the lower column 302 held in place by the plurality of steel rods 326. This process is repeated to construct a frame for a modular unit.

To disassemble the structure, pry bars are inserted into pry bar slots 340, and the upper column 306 is pried free and lifted off of the joist/slab 304, and the joist/slab 304 is likewise pried free and lifted off of the lower column 302. Thus, the upper column 306, the joist/slab 304, the lower column 302, and the steel rods 326 can be easily separated and reused.

In another embodiment, the plurality of steel rods 326 is first cooled with liquid nitrogen to cause the steel rods 326 to shrink in diameter. The steel rods 326 are then inserted into the receptacle 308 of the lower column 302.

The joist 304 is then lowered over and aligned with the lower column 302 so that the steel rods 326 can pass through the through hole 312. The widened opening 320 allows easy insertion of the steel rods 326 into the through hole 312. The joist 304 is then lowered and placed on top of the lower column 302.

Once the joist 304 is in place on top of the lower column 302, the upper column 306 is then lowered over and aligned with the joist 304 so that the steel rods 326 can be inserted into the receptacle 314. The widened opening 324 allows easy insertion of the steel rods 326 into the receptacle 314. The upper column 306 is then lowered and placed on top of the joist 302, and the steel rods 326 slide into the receptacle 314.

When the steel rods 326 heat up to the ambient temperature, the diameters of the steel rods 326 increase and thereby create a friction fit with the receptacles 314 and 308. The result is a rigid structure that includes the upper column 306, the joist/slab 304 and the lower column 302 held in place by the steel rods 326. This process is repeated to construct a frame for a modular unit. The access ports 310 and 316 are covered/sealed with a fireproof plug when not being used to insert liquid nitrogen.

To disassemble the structure, liquid nitrogen is pumped into the access ports 310 and 316, flows into the receptacles 314 and 308, and contacts the steel rods 326. The liquid nitrogen again causes the outer diameter of each of the steel rods 326 to decrease, and thereby allows the upper column 306, the joist 304, the lower column 302, and the steel rods 326 to be easily separated and reused.

Figure 4A:
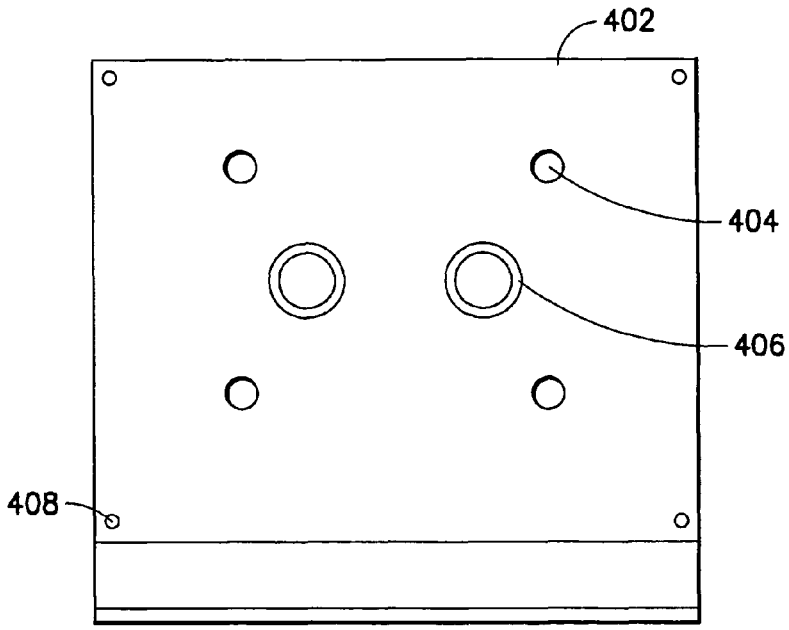
FIG. 4A is an illustrative front view of a female steel plate, according to one embodiment of the invention.

In another embodiment, the upper column 306 and the joist/slab 304 can be cast in to one piece. A steel receptacle would then be embedded in the bottom of the joist. The lower column 302 can be connected to the upper column/joist slab piece using the method described above In another embodiment, an upper column and a lower joist/column unit are anchored together using steel plates. Referring to FIG. 4A, a "female" steel plate 402 is shown. The female steel plate 402 is approximately ⅝ inch thick and includes set screw/alignment holes 406, threaded bolt holes 404, and concrete anchors 408.

Figure 4B:
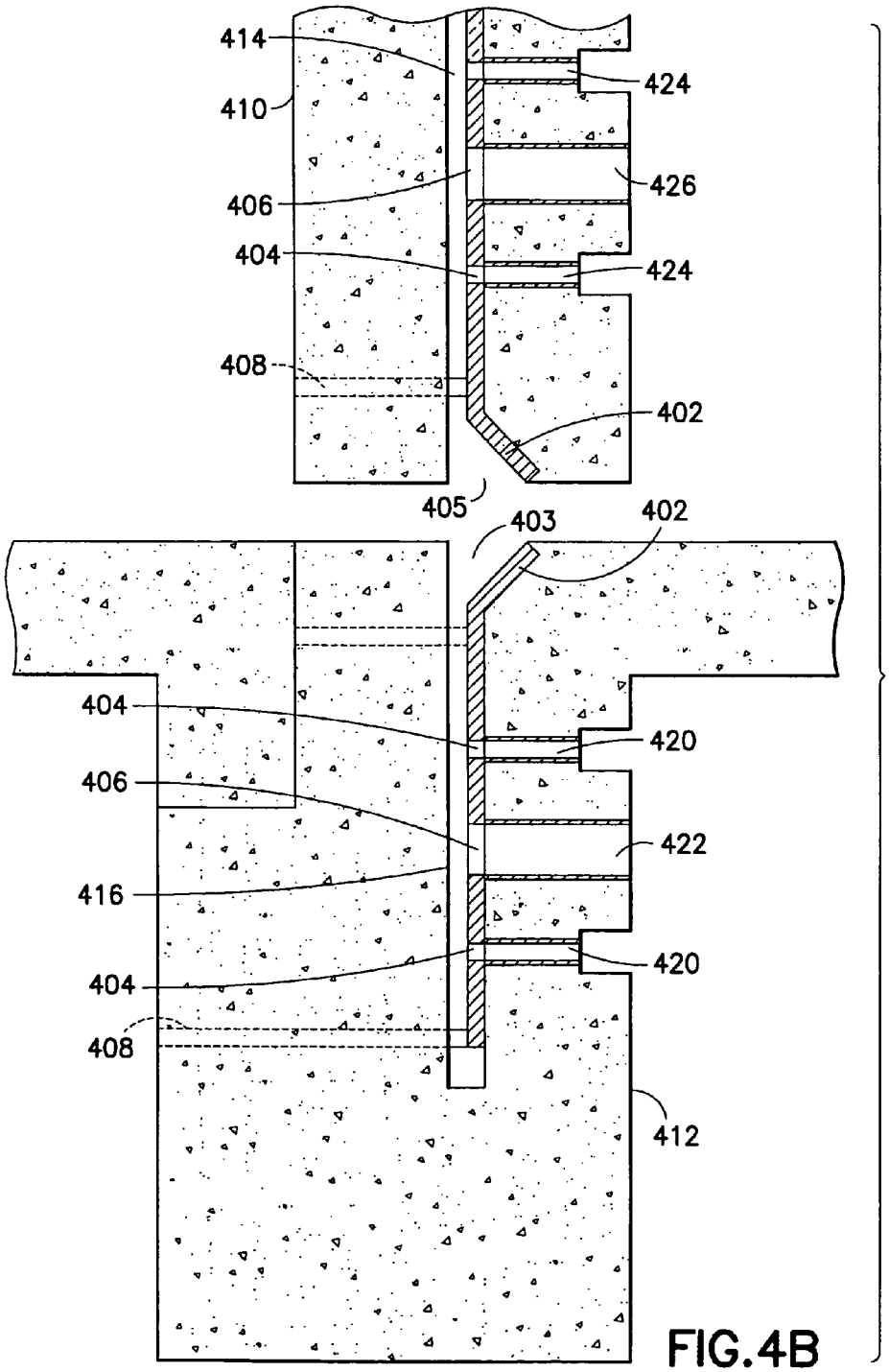
FIG. 4B is an illustrative cross-sectional side view of a top column and a joist/bottom column each including a female steel plate embedded therein, according to one embodiment of the invention.

Referring to FIG. 4B, one female plate 402 is integrated with a steel receptacle 414 and embedded in a concrete upper column 410 and one female plate 402 is integrated with a steel receptacle 416 and embedded in a joist/column unit 412. The concrete anchors 408 hold the female steel plates 402 and steel receptacles 414, 416 in place.

The upper column 410 also includes access ports 426, which are aligned with the set screw holes 406, and access ports 424, which are aligned with threaded bolt holes 404. The receptacle 414 includes a widened opening 405 that is configured to receive a "male" steel plate, which is discussed in detail below.

The joist/column unit 412 also includes access ports 422, which are aligned with the set screw holes 406, and access ports 420, which are aligned with threaded bolt holes 404. The receptacle 416 includes a widened opening 403 that is configured to receive the "male" steel plate, which is discussed in detail below.

Figure 4C:
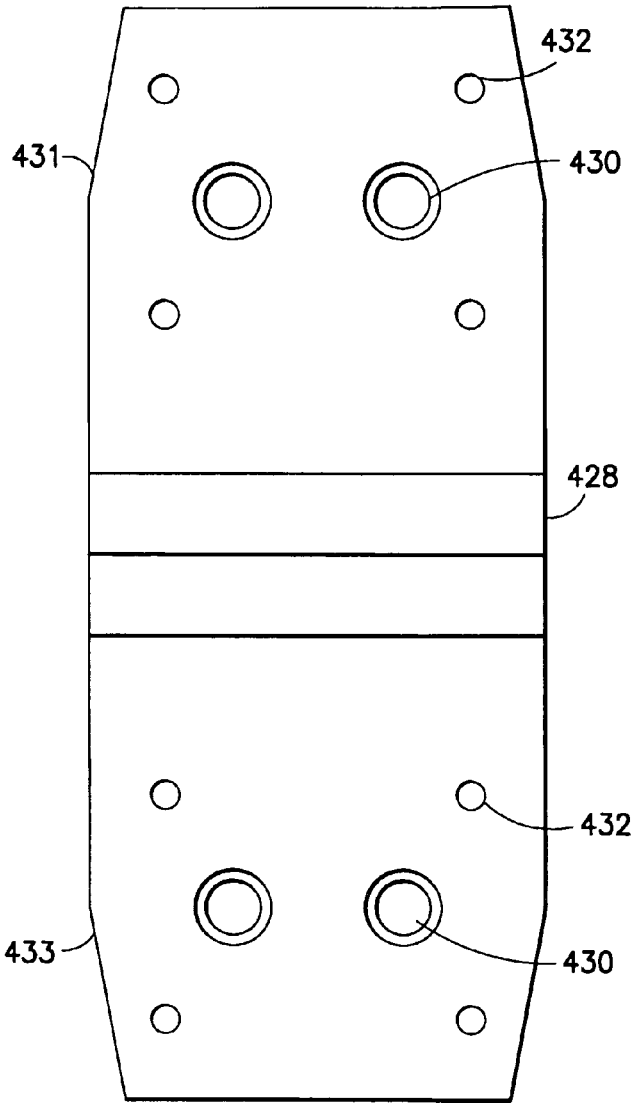
FIG. 4C is an illustrative front view of a male steel plate, according to one embodiment of the invention.
Figure 4D:
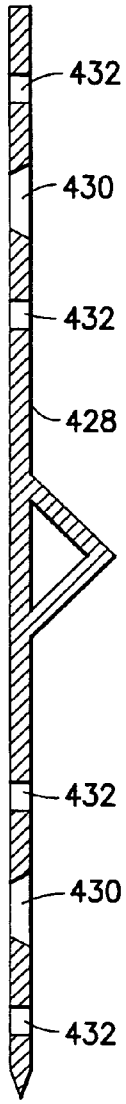
FIG. 4D is an illustrative side view of a male steel plate, according to one embodiment of the invention.

Referring to FIGS. 4C-4D, a "male" steel plate 428 is shown. The male plate 428 is approximately ⅝ inch thick and includes set screw/alignment holes 430, and threaded bolt holes 432 on a top portion 431 and a bottom portion 433

Figure 4E:
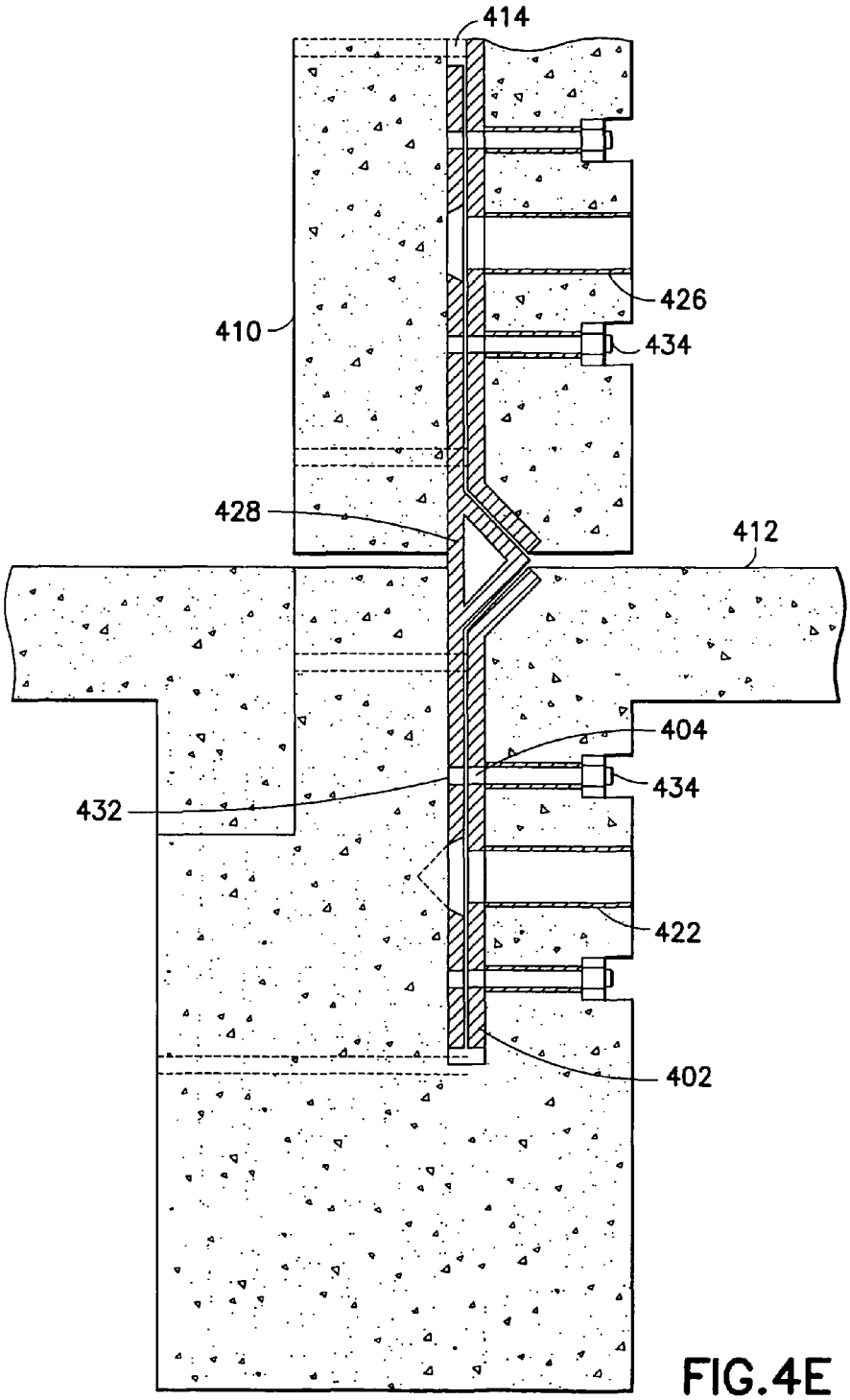
FIG. 4E is an illustrative cross-sectional side view of a top column and a joist/bottom column each including a female steel plate embedded therein mated with a male steel plate, according to one embodiment of the invention.
Figure 4F:
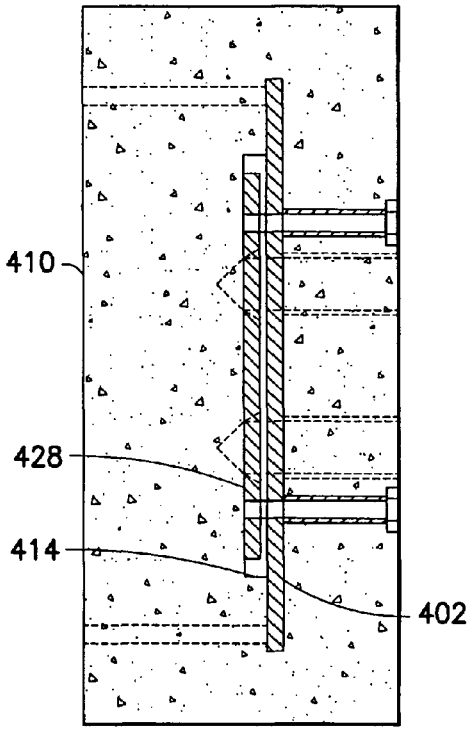
FIG. 4F is an illustrative cross-sectional side view of a top column with an embedded female steel plate mated to a male steel plate.

Referring to FIGS. 4E-4F, the bottom portion 433 of the male plate 428 is inserted into receptacle 416, which is sized and dimensioned to allow the male plate 428 to be moved in both the vertical and horizontal directions to allow the male plate 428 to be properly aligned with the female plate 402. A set screw or a steelworker's tapered pin is inserted into the access port 422 to access the set screw/alignment holes 406 and 430 to move the male plate 428 up or down and/or left or right to align the male plate set screw/alignment holes 430 with the female set screw/alignment holes 404. After the set screw/alignment holes 430, 404 are aligned, threaded bolts 434 are screwed in through access ports 420 and then capped with fireproof plugs. Thereafter, shims, grout, or epoxy can be added into the receptacle 416 to fill in any gaps.

Next the column 410 is moved above, and aligned with, the joist/column unit 412 so that the top portion 431 of the male plate 428 can be inserted into the receptacle 414. The column 410 is lowered onto the joist/column unit 412 and the male plate 428 slides into the receptacle 414. As described above, a set screw or a steelworker's tapered pin is inserted into the access port 426 to access the set screw/alignment holes 406 and 430 to move the male plate 428 up or down and/or left or right to align the male plate set screw/alignment holes 430 with the female set screw/alignment holes 404. In the event the set screw/alignment holes 406 and 430 do not line up properly, the male plate 428 can be replaced with another male plate that is ¼" to ⅜" longer or shorter.

After the set screw/alignment holes 430, 404 are aligned, threaded bolts 434 are screwed in through access ports 426 and then capped with fireproof plugs. Thereafter, grout or epoxy can be added into the receptacle 416 (through an additional access port not shown) to fill in any gaps. The result is a rigid structure that includes the upper column 410 and the joist/column unit 412 held in place by the steel plates 402, 428. This process is repeated to construct a frame for a modular unit.

To disassemble the structure, bolts 434 are removed, and the upper column 410 is lifted off of the joist/column unit 412. If grout or shims were also used, a pry bar or impact hammer can be used to pry the shims or loosen the grout. If epoxy was also used, a solvent can be added to dissolve the solvent. Thereafter, the upper column 410, the joist/column unit 412, and the steel plates 402, 428 are available for reuse.

In another embodiment, the above method can be used to connect an upper column, a joist/slab, and a separate lower column. In this embodiment, the above method is simply repeated for the joist/slab and lower column connection.

In another embodiment, instead of embedding a male and female plate inside a column and a column/joist assembly, steel brackets can be bolted to the outside of the column and column/joist assembly to produce a stable and rigid structure. In this embodiment, the outside plates are covered with a fireproof material.

Referring to FIGS. 5A-5D, in another embodiment, a method of securing a stabilizing steel rod in a concrete column involves using a notched steel rod 502 and two or more steel plates 504 with an opening 505.

Figure 5A:
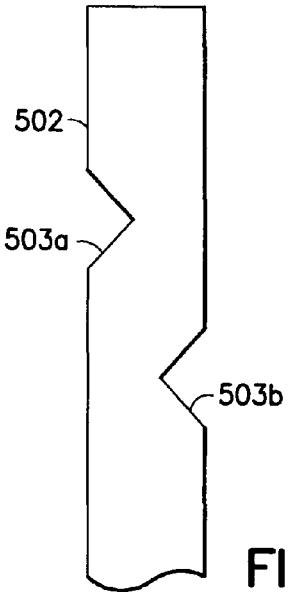
FIG. 5A is an illustrative partial side view of a notched steel rod, according to one embodiment of the invention.
Figure 5B:
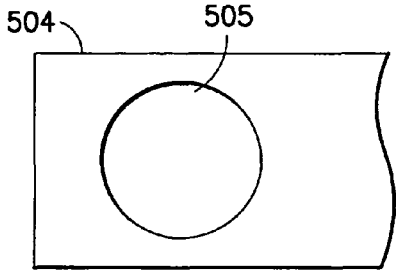
FIG. 5B is an illustrative top view of a steel plate used to engage a notched steel rod, according to one embodiment of the invention.
Figure 5C:
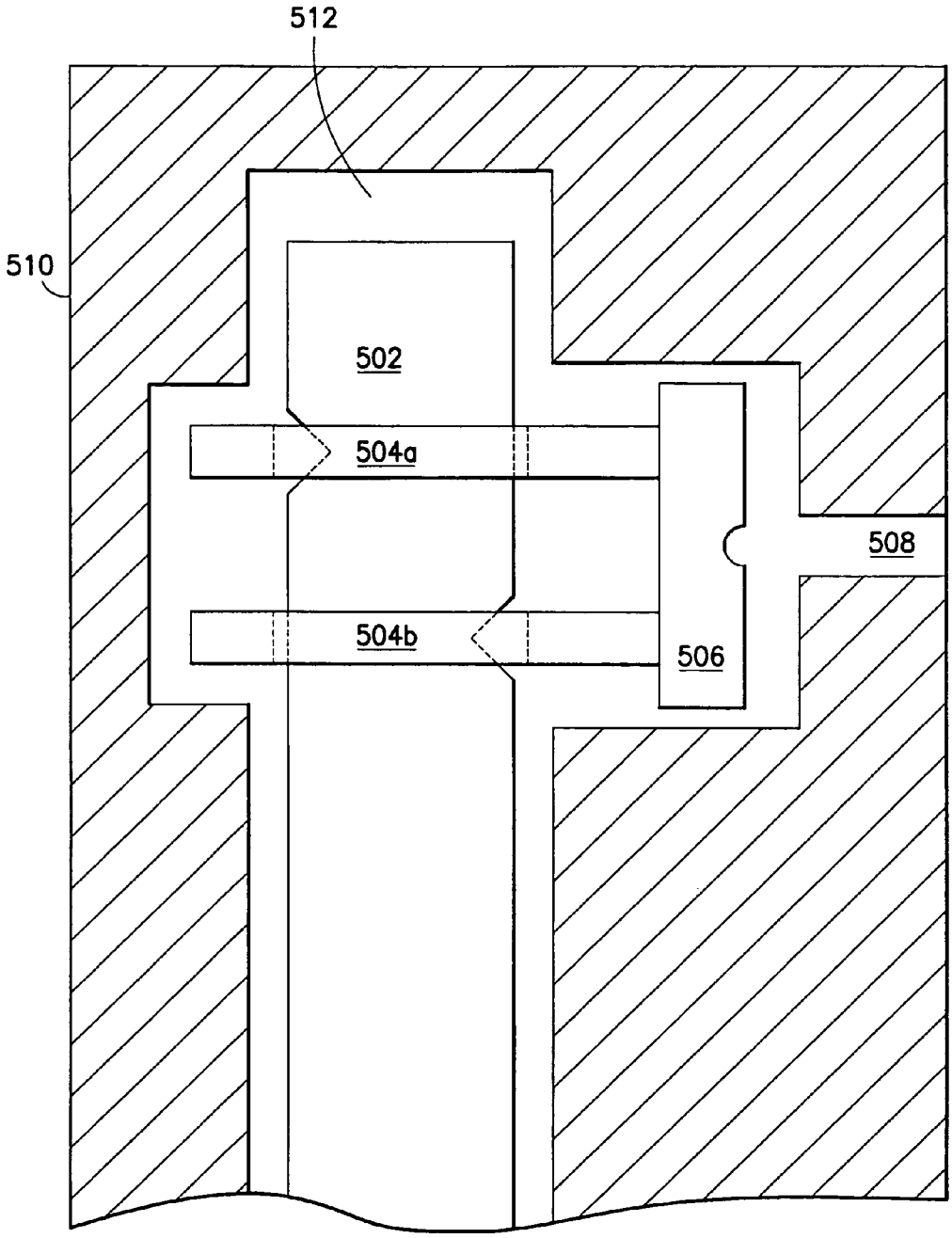
FIG. 5C is an illustrative partial cross-sectional side view of a column including an embedded receptacle and a keyed locking mechanism for engaging a notched steel rod in an unengaged state, according to one embodiment of the invention.
Figure 5D:
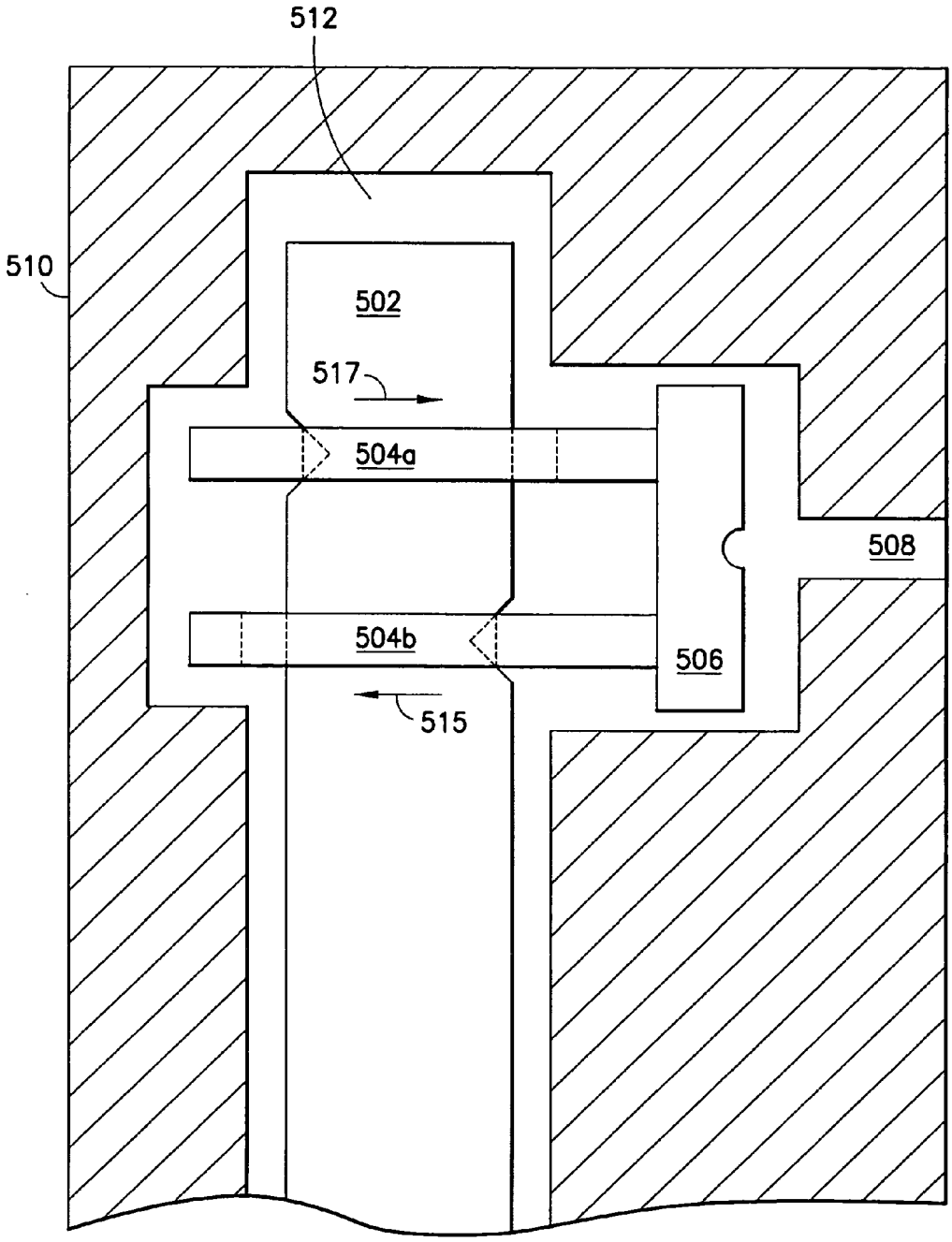
FIG. 5D an illustrative partial cross-sectional side view of a column including an embedded receptacle and a keyed locking mechanism for engaging a notched steel rod in an engaged state, according to one embodiment of the invention.

As shown in FIG. 5C, two horizontal steel plates 504*a* and 505*b* are embedded in a steel receptacle 512 that is embedded in a concrete column 510. The plates 504*a* and 505*b* are coupled to a gear mechanism 506 that moves the steel plates 504*a* and 505*b* in opposite directions along an axis that is perpendicular to the longitudinal axis of the receptacle 512. The gear mechanism 506 that moves the steel plates 504*a* and 505*b* when a key is inserted though an access port 508, engages the gear mechanism, and is turned. When the key is turned in one direction, the plates 504*a* and 505*b* are moved to an unlocked position as shown in FIG. 5C. In the unlocked position, the openings 505 of the steel plates 504*a* and 505*b* share the same axis and the notched steel rod 502 is allowed to freely slide therethrough. When the key is turned in the opposite direction, the plates 504*a* and 505*b* are moved (shown by arrows 515 and 517) to a locked position as shown in FIG. 5D. In the locked position, the opening 505 of the steel plate 504*a* engages notch 503*a* and the opening 505 of the steel plate 504*b* engages notch 503*b* thereby locking the steel rod 502 in place. To remove the steel rod 502, the key is simply inserted into the access port 508 to engage the gear mechanism, and move the steel plates 504*a* and 505*b* back to the unlocked position.

Figure 6A:
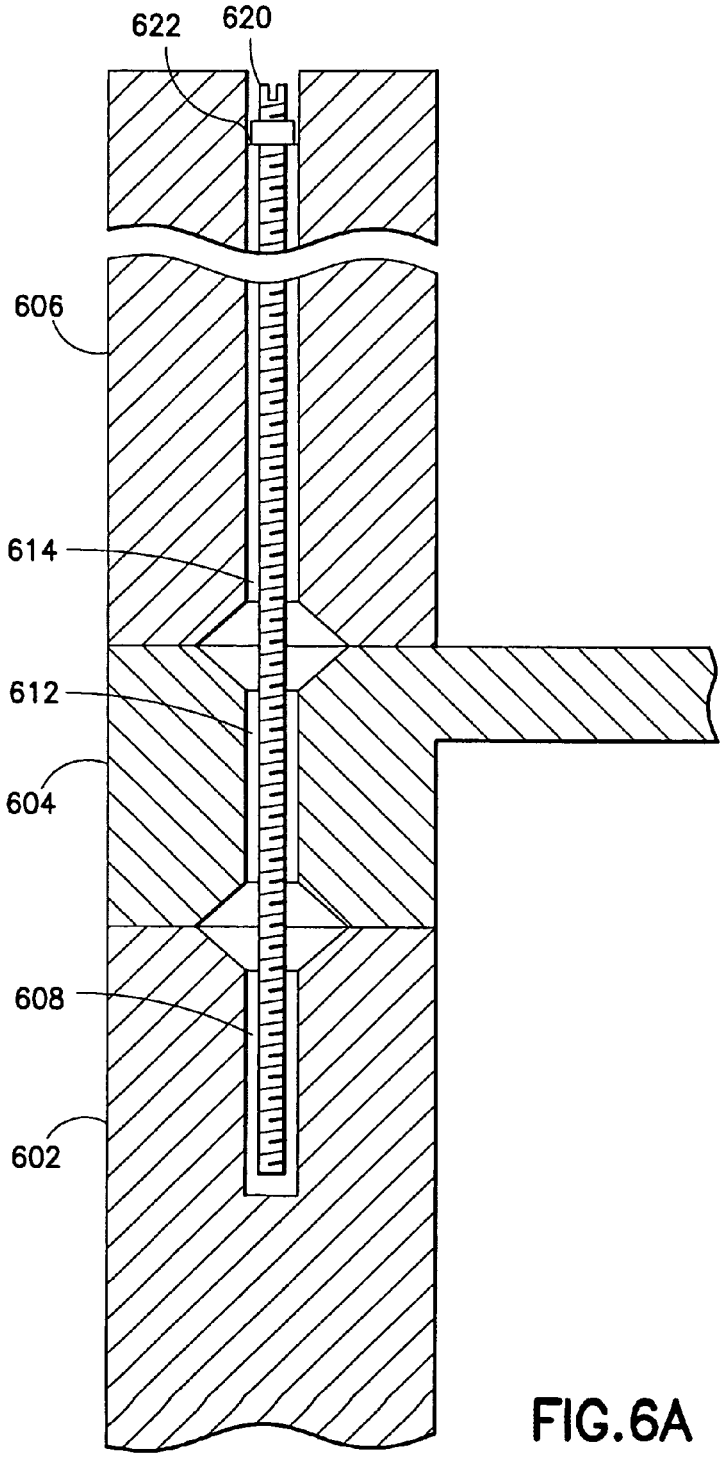
FIG. 6A is an illustrative cross-sectional side view of an upper column, a joist, and a lower column assembly with a threaded steel rod disposed in and extending through the upper column and the joist, and into the lower column, according to one embodiment of the invention.

Referring to FIG. 6A, in yet another embodiment, a side view of an upper column 606, a joist and slab 604, and a lower column 602 assembly with a threaded steel rod 620 disposed in, and extending through, the upper column 606, the joist 604, and into the lower column 602 is shown. The upper column 606 includes an embedded steel receptacle 614, the joist and slab 604 includes an embedded steel receptacle 612, and the lower column 602 includes an embedded steel receptacle 608.

In this embodiment, the upper column 606, the joist and slab 604, and the lower column 602 are stacked and aligned so that the embedded steel receptacles 614, 612, and 608 are also aligned. The threaded steel rod 620 is inserted through opening 622 in the top of the column 606. Grout is then poured into the opening 602 and allowed to dry. The opening 622 and the end of the steel rod 620 are then covered with a fireproof plug. The result is a rigid structure that includes the upper column 606, the joist/slab 604 and the lower column 602 held in place by the threaded steel rod 620. This process is repeated to construct a frame for a modular unit.

In another embodiment, the threaded steel rod 620 is first inserted into a snug plastic sleeve that can have an outer surface that is smooth or threaded. The threaded steel rod 620 and sleeve are then inserted through opening 622 into the structure and surrounded by grout.

Figure 6B:
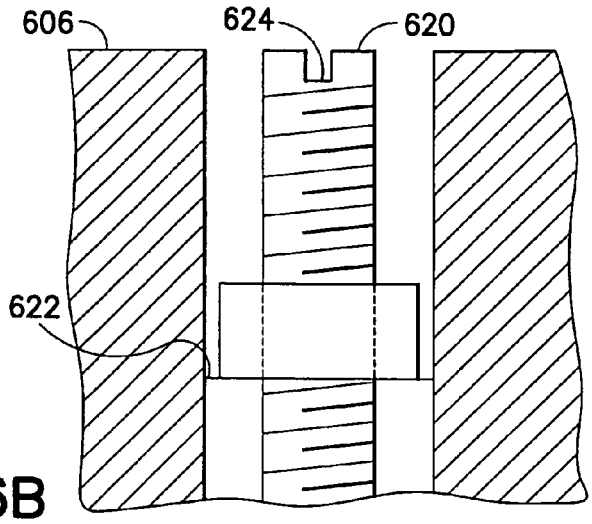
FIG. 6B is an illustrative partial cross-sectional side view of a notched end of a threaded steel bar that extends out of an upper column, a joist, and a lower column assembly, according to one embodiment of the invention.

Referring to FIG. 6B, to disassemble the structure, a twist bar or impact hammer drive is coupled to a notch 624 that is cut into the top of the threaded steel bar 620. The threaded steel bar is twisted back and forth to break up the surrounding grout. Thereafter, the threaded steel bar 620 is removed and the upper column 606, the joist/slab 604 and the lower column 602 can be separated and reused.

Figure 7A:
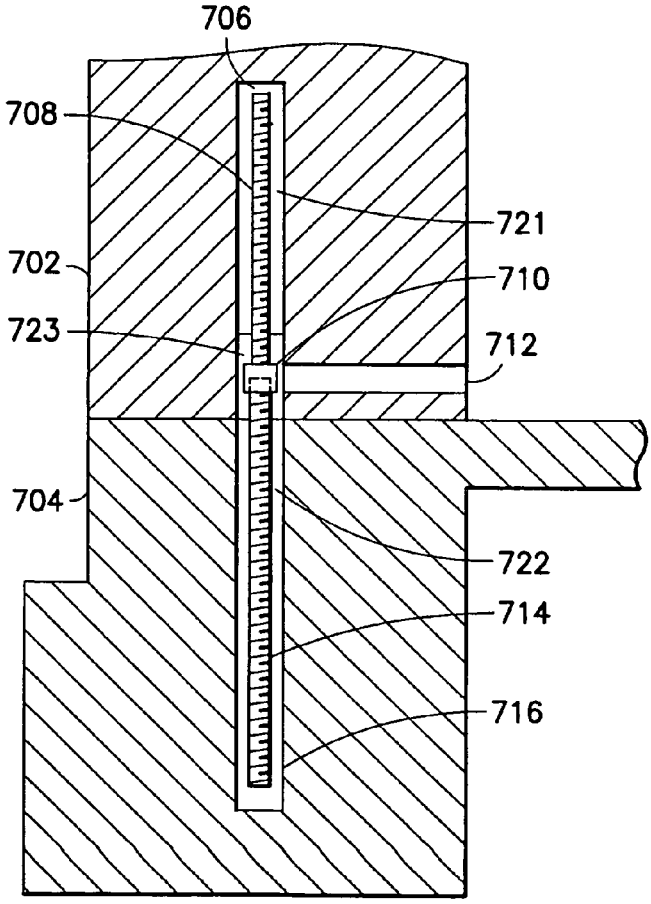
FIG. 7A is an illustrative cross-sectional side view of a top column and a joist/bottom column each including a threaded steel rod embedded therein, where the steel rods are coupled together with a slip connector, according to one embodiment of the invention.
Figure 7B:
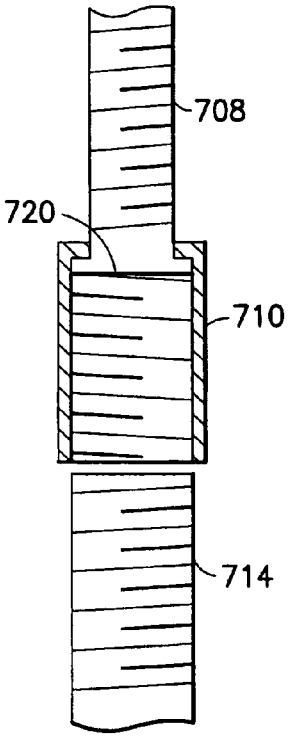
FIG. 7B is an illustrative cross-sectional side view of a threaded slip connector disposed at an end of a threaded steel rod, according to one embodiment of the invention.

Referring to FIGS. 7A and 7B, in yet another embodiment, a cross-sectional side view of a top column 702 and a joist/bottom column 704 is shown. The top column 702 includes a steel receptacle 706 embedded therein. A threaded steel bar 708 is disposed in the steel receptacle 706 and surrounded by grout 721. The threaded steel bar 708 includes a free spinning retractable slip connector 710 that is coupled to steel bar 708 via a flange 720. The slip connector 710 is accessible via access port 712. The slip connector 710 is disposed inside the receptacle 706 in an area 723 that is free of grout.

The joist/bottom column 704 includes a steel receptacle 716 embedded therein. A threaded steel bar 714 is disposed in the steel receptacle 716 and surrounded by grout 722. The threaded steel bar 714 extends out of the steel receptacle 716 so that it can be inserted into the steel receptacle 706 to mate with the slip connector 710.

To assemble the structure, the column 702 is lowered over, and aligned with, the joist/bottom column 704 so that the threaded steel bar 714 that extends out of the steel receptacle 716 can be inserted into the receptacle 706. The column 702 is lowered onto the joist/bottom column 704 and the end of the steel bar 714 pushes the slip connector 710 back to meet the steel bar 708. A tool is then inserted into the access port 712 to turn the slip connector 710 and engage the steel bar 714, thereby coupling the steel bars 708 and 714. The result is a rigid structure that includes the upper column 702 and the joist/bottom column 704 held in place by the coupled threaded steel rods 708 and 714. This process is repeated to construct a frame for a modular unit. The access port 712 is covered/sealed with a fireproof plug when not being used.

To disassemble the structure, a tool is inserted into the access port 712 to turn the slip connector 710 and decouple the threaded steel rods 708 and 714. Thereafter, the upper column 702 and the joist/bottom column 704 can be separated and reused.

Figure 8A:
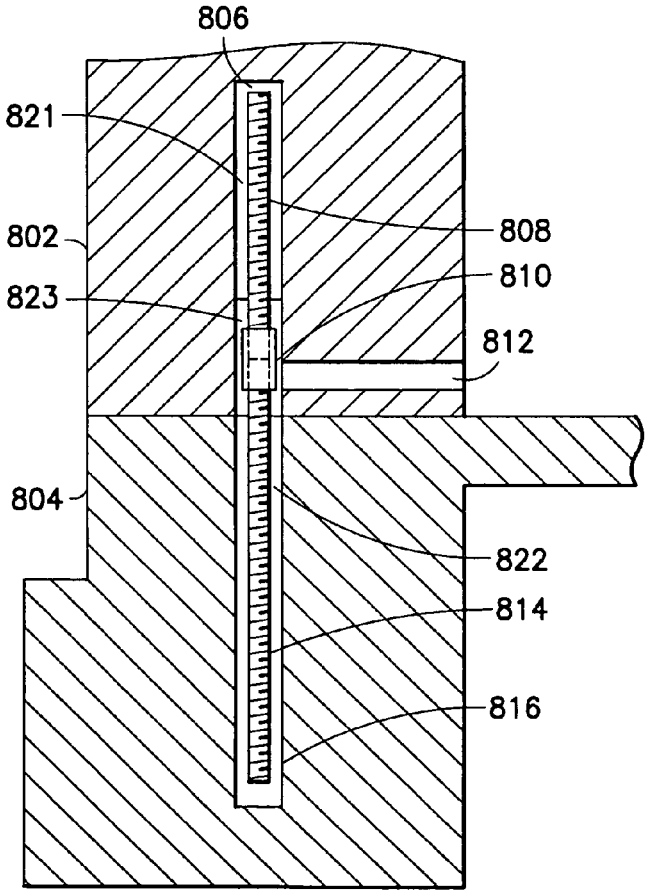
FIG. 8A is an illustrative cross-sectional side view of a top column and a joist/bottom column each including a threaded steel rod embedded therein, where the steel rods are coupled together with a threaded coupler, according to one embodiment of the invention.
Figure 8B:
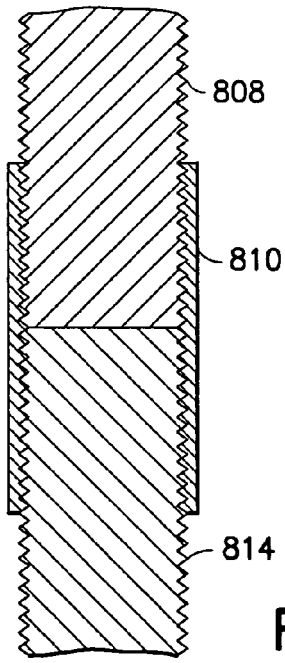
FIG. 8B is an illustrative cross-sectional side view of a threaded coupler joining two threaded steel rods together, according to one embodiment of the invention.

Referring to FIGS. 8A and 8B, in still another embodiment, a cross-sectional side view of a top column 802 and a joist/bottom column 804 is shown. The top column 802 includes a steel receptacle 806 embedded therein. A threaded steel bar 808 is disposed in the steel receptacle 806 and surrounded by grout 821. The threaded steel bar 808 includes a four inch threaded coupler 810 that is coupled steel bar via threads. The threaded coupler 810 is accessible via access port 812. The threaded coupler 810 is disposed inside the receptacle 806 in an area 823 that is free of grout.

The joist/bottom column 804 includes a steel receptacle 816 embedded therein. A threaded steel bar 814 is disposed in the steel receptacle 816 and surrounded by grout 822. The threaded steel bar 814 extends out of the steel receptacle 816 so that it can be inserted into the steel receptacle 806 to mate with the threaded coupler 810.

To assemble the structure, the column 802 is lowered over, and aligned with, the joist/bottom column 804 so that the threaded steel bar 814 that extends out of the steel receptacle 816 can be inserted into the receptacle 806. The threaded coupler 810 is turned so that it retracts to a position such that it does not extend beyond the end of the steel bar 808. The column 802 is lowered onto the joist/bottom column 804 and the end of the steel bar 814 meets the end steel bar 708.

A tool is then inserted into the access port 812 to turn the threaded coupler 810 and engage the steel bar 814, thereby coupling the steel bars 808 and 814. In one embodiment, the coupler 810 is hex coupler and is turned by a wrench. In another embodiment, the coupler includes holes disposed along its circumference. The holes are adapted to receive a hex square or ⅜" round bar to turn the coupler from the access port.

The result is a rigid structure that includes the upper column 802 and the joist/bottom column 804 held in place by the coupled threaded steel rods 808 and 814. This process is repeated to construct a frame for a modular unit. The access port 812 is covered/sealed with a fireproof plug when not being used.

To disassemble the structure, a tool is inserted into the access port 812 to turn the threaded coupler 810 and decouple the threaded steel rods 808 and 814. Thereafter, the upper column 802 and the joist/bottom column 804 can be separated and reused.

According to another aspect, the invention involves connecting sheer walls together in such a way that the sheer walls can be easily disassembled and reused.

Figure 9A:
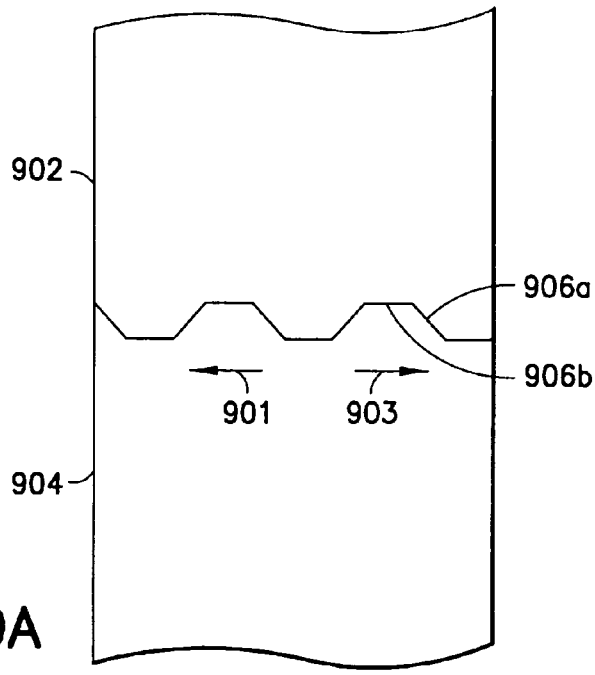
FIG. 9A is an illustrative front view of a top sheer wall interlocking with a bottom sheer wall by means of an alternating key, according to one embodiment of the invention.

Referring to FIG. 9A, in one embodiment, a front view of a top sheer wall 902 interlocking with a bottom sheer wall 904 by means of an alternating key 906*a*, 906*b* is shown. The key 906 counteracts forces in the directions indicated by arrows 901 and 903 (i.e., lateral loads).

To oppose forces that are perpendicular to the sheer walls 902, 904 (i.e., out of the page), steel plates can be added to each side of, and at the location of, the alternating key 906*a*, 906*b*.

Figure 9B:
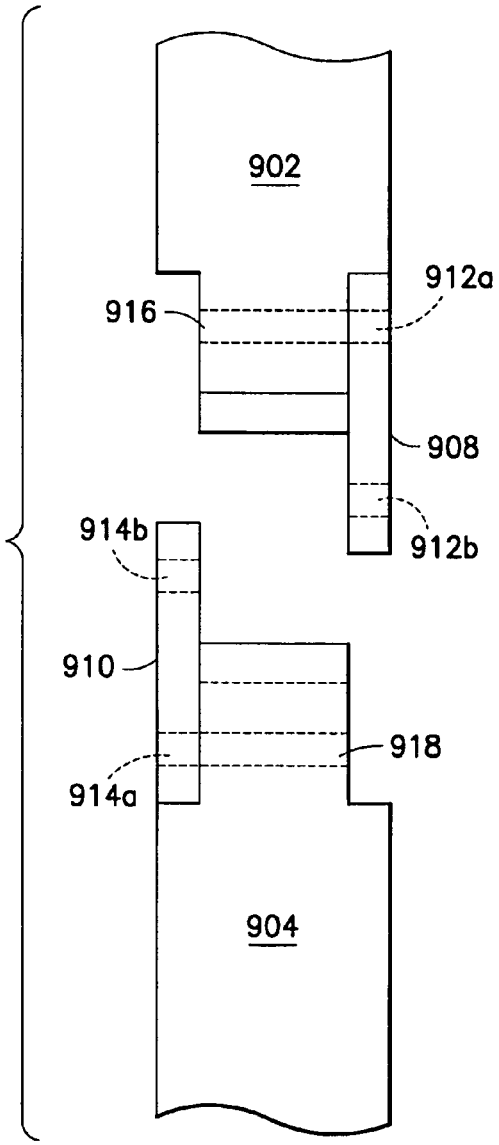
FIG. 9B is an illustrative side view of a top sheer wall including an embedded steel plate and a bottom sheer wall including an opposing embedded steel plate, according to one embodiment of the invention.

Referring to FIG. 9B, in one embodiment, a side view of the top sheer wall 902 that includes an embedded steel plate 908, and a bottom sheer wall 904 that includes an opposing embedded steel plate 910 is shown. The plate 908 includes bolt through holes 912*a* and 912*b*. The bolt through hole 912*a* is aligned with a through hole 916 that extends through the top sheer wall 902. The bolt through hole 912*b* is arranged to align with a through hole 918 that extends through the bottom sheer wall 904. The plate 910 includes bolt through holes 914*a* and 914*b*, which are threaded and configured to receive bolts. The bolt through hole 914*a* is aligned with the through hole 918 that extends through the top sheer wall 902. The bolt through hole 914*b* is arranged to align with the through hole 916 that extends through the top sheer wall 902.

Figure 9C:
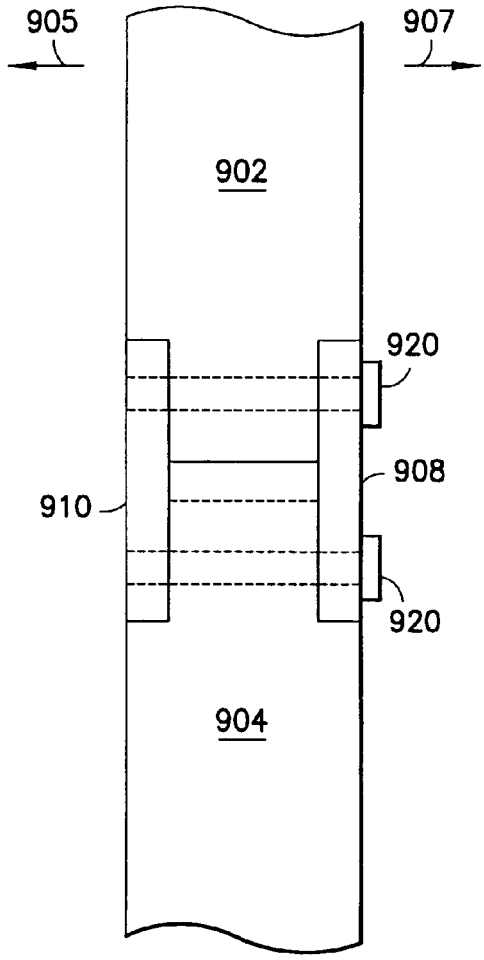
FIG. 9C is an illustrative side view of a top sheer wall including an embedded steel plate coupled to a bottom sheer wall including an opposing embedded steel plate, according to one embodiment of the invention.

Referring to FIG. 9C, to assemble the sheer walls 902 and 904, the top sheer wall 902 is lowered above, and aligned with, the sheer wall 904 such that the key 906*a* aligns with the key 906*b*. The top sheer wall 902 is lowered on top of the lower sheer wall 904, and the plate 908 engages the lower sheer wall 904 while the plate 910 engages the upper sheer wall 902. Bolts 920 are then inserted in bolt holes 912*a* and

912*b* and engage threaded bolt holes 914*a* and 914*b*. The plates 908 and 910 counteract forces in the directions indicated by arrows 905 and 907.

It should also be understood that the above-described methods for assembling and disassembling a column and a joist/slab can be used to attach additional columns and joist slabs. Further, the above described methods can also be used to assemble and disassemble sections of a sheer wall in both vertical and horizontal directions. The above-described methods enhance the properties of tension and compression of the sheer walls.

According to another aspect, the invention involves a method of assembling an interior wall partition.

Figure 10:
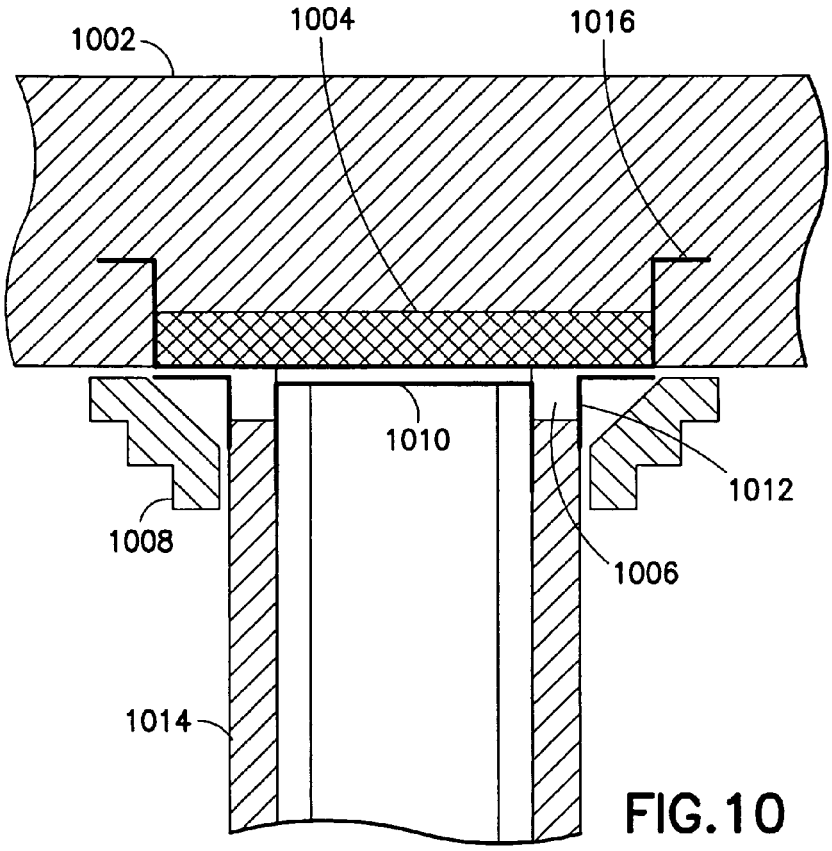
FIG. 10 is an illustrative cross-sectional diagram of a ceiling slab coupled to an interior wall partition, according to one embodiment of the invention.

Referring to FIG. 10, in one embodiment, a cross-sectional diagram of a ceiling slab 1002 coupled to a wall partition 1014 is shown.

The ceiling slab 1002 includes a metal ground 1016 and a foam spacer 1004 embedded therein. An upside down metal "U" shaped bracket 1010 is embedded in the top of the partition wall partition 1014. The wall partition 1014 is coupled to the ceiling slab 1002 by attaching angle brackets 1012 to both the metal ground 1016 and the "U" shaped bracket 1010 with self tapping screws. Crown molding 1008 is then attached to the ceiling slab 1002 and the wall partition 1014 to hide the angle brackets 1012.

This configuration allows for minor adjustments to be made. Specifically, because the metal ground 1016 is designed to be wider than the wall partition 1010, minor adjustments in the placement of the wall partition 1010 can be made. Finally, acoustical caulking 1006 is disposed in the gaps that exist between the top of each wall partition 1014*a* and 1014*b* and the ceiling slab 1002.

Figure 11A:
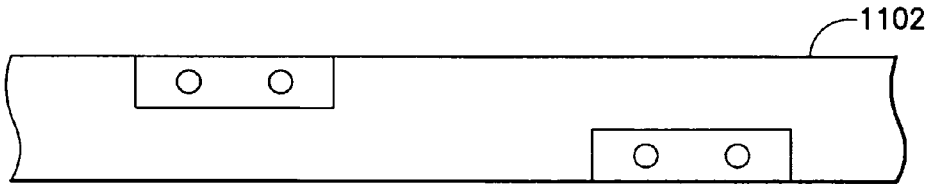
FIG. 11A is an illustrative diagram of a steel tube used for attaching a wall partition to a floor/ceiling assembly, according to one embodiment of the invention.
Figure 11B:
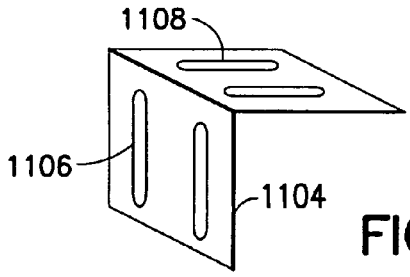
FIG. 11B is an illustrative perspective diagram of a ceiling clip, according to one embodiment of the invention.
Figure 11C:
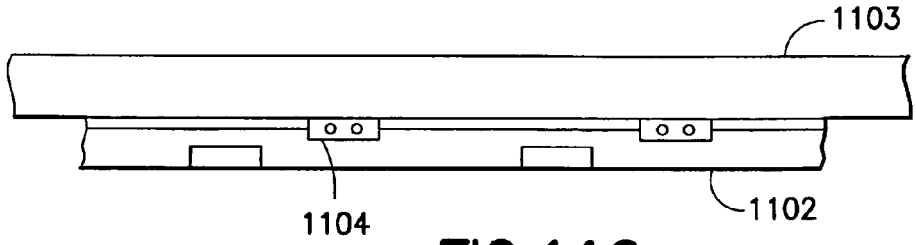
FIG. 11C is an illustrative diagram of a floor/ceiling assembly with an attached steel tubing used for attaching a wall partition, according to one embodiment of the invention.

Referring to FIGS. 11A-C, in another embodiment, a non load bearing tube 1102 is attached to a floor/ceiling assembly 1103 via ceiling clips 1104. The ceiling clip 1104 is an "L" shaped bracket with slotted holes 1106 and 1108. The horizontal plate of the ceiling clip 1104 is attached (with screws or bolts through slotted holes 1108) to the underside of the floor/ceiling assembly 1103. The vertical plate of the ceiling clip 1104 is then attached (with screws or bolts thought slotted holes 1106) to the non load bearing tube 1102. The non load bearing tube 1102 is used to attach wall partitions, which are described in detail below. The slotted holes 1106 and 1108 allow the ceiling clip 1104 to be properly and easily positioned.

Figure 12A:
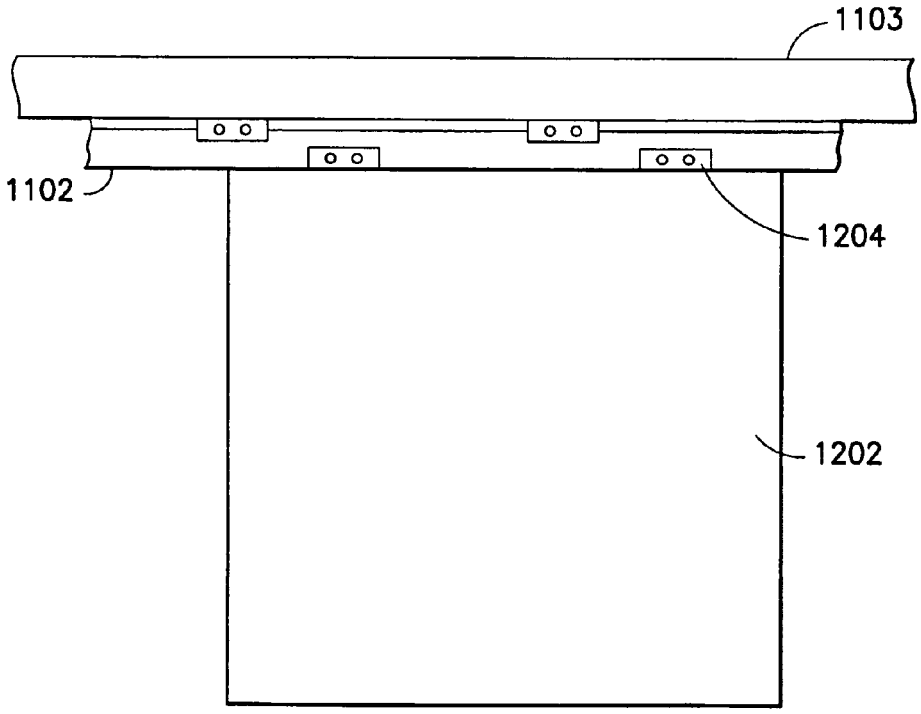
FIG. 12A is an illustrative diagram of a wall partition attached to a steel tube, according to one embodiment of the invention.
Figure 12B:
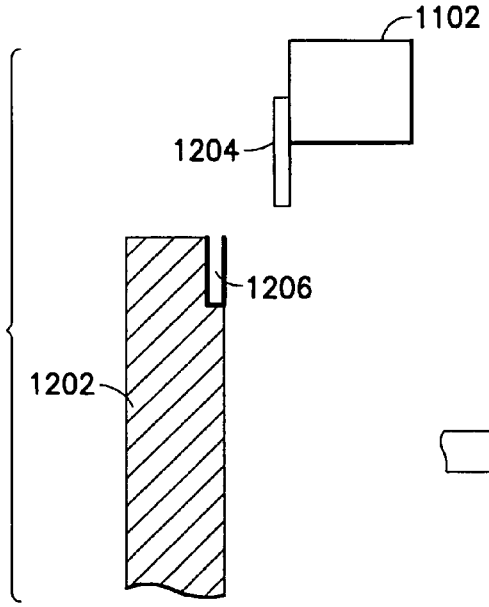
FIG. 12B is an illustrative diagram of a wall partition clip and a slotted clip, according to one embodiment of the invention.

Referring to FIG. 12A, an illustrative diagram of a wall partition 1202 is shown. The wall partitions 1202 that are positioned within a modular frame or positioned between separate modular frames are attached to the non load bearing tube 1102 (which is attached a floor/ceiling assembly 1103 as described above). The wall partition 1202 is attached to the non load bearing tube 1102 by mating a slotted clip 1204 (which is attached to the non load bearing tube 1102, see FIG. 12B) with a partition clip 1206 (which is attached to the wall partition 1202, see FIG. 12B). The wall partition clip 1206 is an up facing "U" that is configured to receive the slotted clip 1204.

Figure 12C:
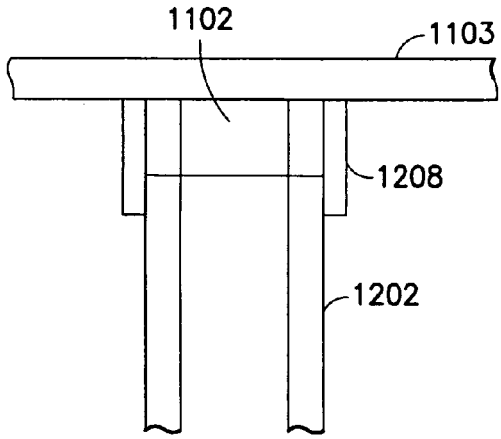
FIG. 12C is an illustrative diagram of two wall partitions attached to a steel tube with the steel tube covered by molding, according to one embodiment of the invention.

The vertical dimension of wall portion 1202 and the slotted clips 1204 are less than the height of the frame so that shipping or fireproofing material can be installed above the frame, and removed before the frame is covered by another frame. The non load bearing tube 402 is narrower than the "U" clips and can be shimmed after ceiling/floor assembly 1103 is placed into the frame. Ceiling clip 1104 (see FIG. 11C) is used to make minor adjustments to be certain that wall portion 1202 is plum. Fireproofing is then installed to fill the gap on either side of the non load bearing tube 1102. For wall partitions disposed at the perimeter of the beams of the modular frame, the slotted clips 1204 are part of the field installed pre-cast fireproofing panels. The non load bearing tube 1102 and surrounding fireproofing material is covered by a molding 1208, as shown in FIG. 12C. Further, the wall partition 1202 is attached to floor/ceiling assembly 1103 below it with clips in a similar manner as described above or by conventional floor track or plate connections at a place of modular manufacture.

Figure 12D:
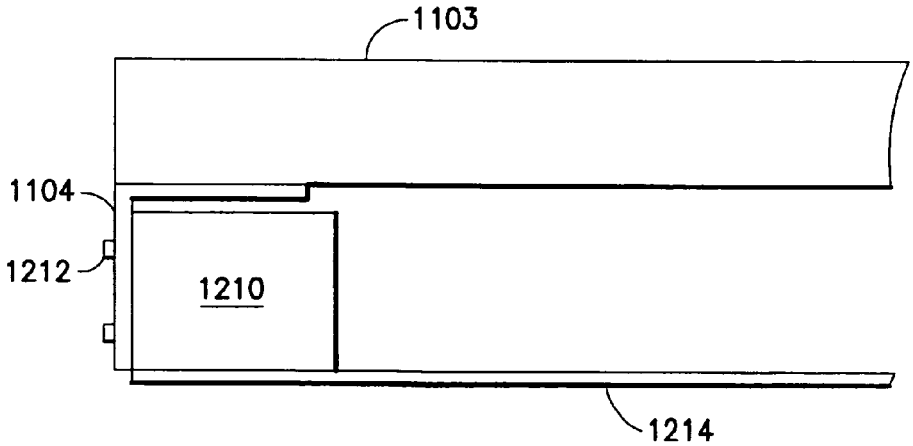
FIG. 12D is an illustrative diagram of blocking and packing material attached to a ceiling clip, according to one embodiment of the invention.

Referring to FIG. 12D, in another embodiment, the ceiling clips 1104 can be used to secure temporary packaging material. Prior to shipping, blocking 1210 is attached to all ceiling clips 1104 with screws 1212 disposed through the holes 1106 that are used to attach the non load bearing tube 1102 at final installation. Packaging material 514 (e.g., ⅝" plywood) is then attached via screws to the blocking 1210. Similarly, blocking 1210 is attached to the slotted clips 1204 on the wall partitions 1202. Packaging material 1214 is then attached to blocking 1210 via screws. Alternatively, the entire module may be shrink-wrapped with heavy gauge plastic, using temporary support ribs to span the open area, connected to structural frame in a similar manner as packaging material 1214.

According to still another aspect, the invention involves using a lightweight fireproof rated material cast into fireproofing forms with tongue and groove ends so that the fireproof forms can be placed adjacent to each other on various structural elements, such as steel or cement columns and beams, to maintain a required fireproof rating for the structural elements. The forms are of a sufficiently short length so that they can be easily installed after the structural elements are positioned in their final configuration.

In one embodiment, the fireproofing forms are used to fireproof any structure after the structure has been built.

Figure 13A:
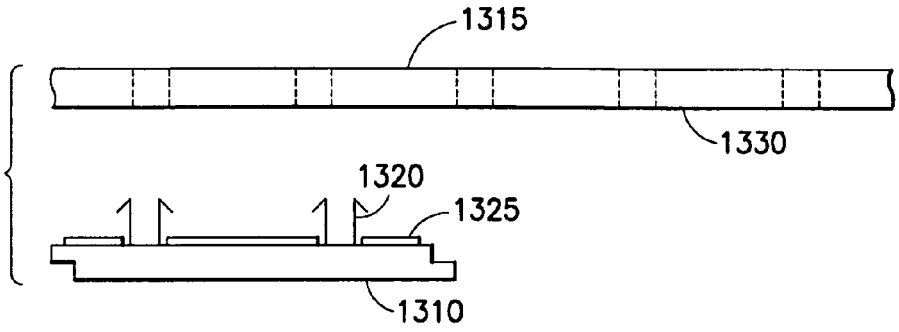
FIG. 13A is an illustrative diagram of a structural member configured to receive fireproofing forms including tension clips, according to one embodiment of the invention.
Figure 13B:
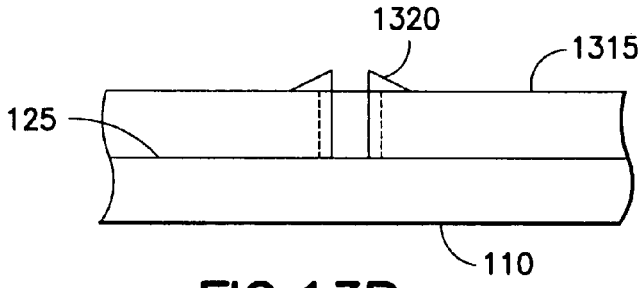
FIG. 13B is an illustrative diagram of a structural member with an attached fireproofing form via tension clips, according to one embodiment of the invention.

Referring to FIGS. 13A and 13B, in one preferred embodiment, the fireproofing forms 1310 are cast into panels with tongue and groove connective ends 1311 and tension clips 1320 at predetermined intervals. The panels can be of any size. The fireproofing forms 1310 are placed next to each other such that the tongue of one panel fits into the groove of an adjacent panel. The fireproofing forms 1310 are held against structural members 1315 with tension clips 1320 and/or adhesives 1325. The structural members 1315 can be made of any material (e.g. steel, iron, fiberglass, wood, etc) that is acceptable for building a structure (e.g., modular building materials and conventional building materials). Holes 1330 are drilled into the structural members 1315 to receive the tension clips 1320. The fireproofing forms 1310 can be made to bridge over structural floor or ceiling members and are also attached with tension clips 1320 and/or adhesives.

In another embodiment, portions of the structural members or the entire structural members 1315 are overlaid or "fireproofed" with fireproofing forms that include preset reliefs for bolts (i.e., cutouts in the fireproofing forms 1310 used to accommodate the bolts).

Figure 13C:
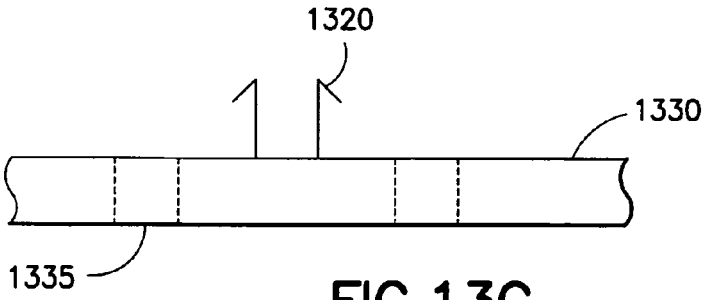
FIG. 13C is an illustrative diagram of a fireproofing form including tension clips and channels, according to one embodiment of the invention.

Referring to FIG. 13C, in still another embodiment, fireproofing forms 1330 are made with channels 1335 for sprinkler piping, electrical conduit, or cables. The fireproofing forms 1330 are typically attached to ceiling structural members, but can also be attached to floor or wall structural members.

Figure 14:
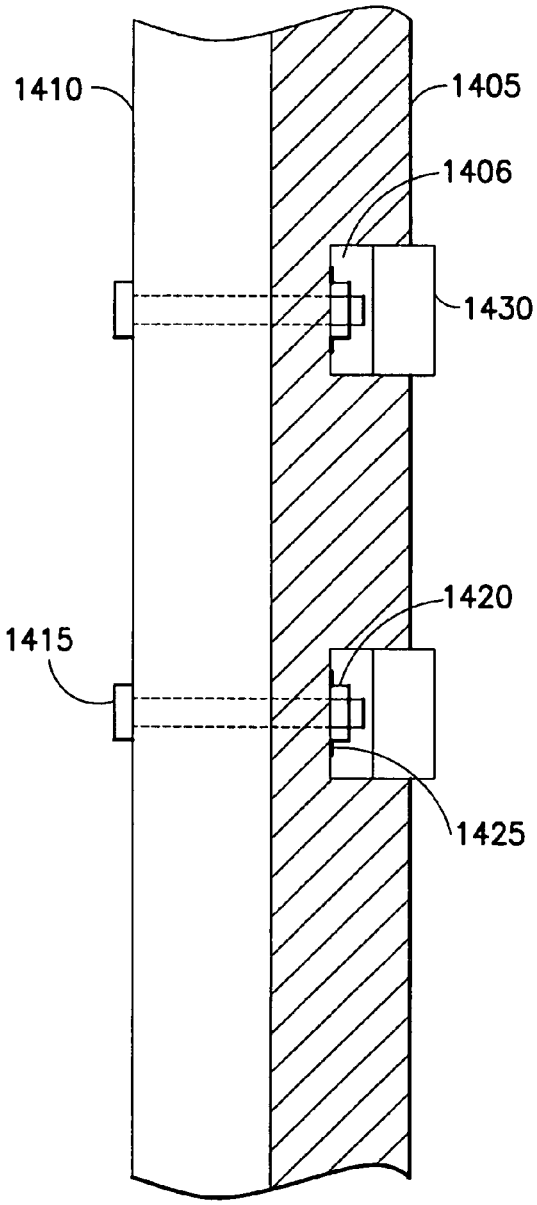
FIG. 14 is an illustrative cross-sectional diagram of a fireproofing form attached to a structural member, according to one embodiment of the invention.

Referring to FIG. 14, in still another embodiment, pre-cast fireproofing forms 1405 are used for fireproofing heavy structural members 1410, which act as support beams in buildings or support members in modular construction units. The fireproofing forms 1405 include cutouts 1406 on an inner surface to receive bolts (or matching nuts), which are used to mount the fireproofing forms 1405 to the structural member 1410.

In another embodiment, the fireproofing forms 1405 are attached with a fastening system that includes a bolt 1415, a nut 1420, and a washer 1425. In this case, fireproof caps 1430 or covers are used to cover the bolt 1415 and/or nut 1420.

In another embodiment, the holes in a modular frame made to receive the clips on the pre-cast fireproofing forms 1405 can be used to secure temporary sides for completed modules during transit from the manufacturer to a destination site.

As part of a fireproof rated system for the floors and ceilings of steel shipping containers, two layers of gypsum or sheetrock are attached to the underside of the ceiling of the container with furring strips or channels. Fire retardant material is inserted into the space between top of the first container and the underside of the container above. Alternatively, fireproofing material can be sprayed on the top of the lower container before another container is placed on top.

In another embodiment, the fireproofing forms can be used as the walls, floor, and or ceiling of modular housing structural elements. The fireproofing forms are made into larger panels that are attached as previously described to side, floor, and/or ceiling support members.

The methods described herein allow modular units to be easily assembled and disassembled for reuse because no welding or wet trades are required. This enables environmentally responsible construction because the modular units are recyclable.

Variations, modifications, and other implementations of what is described herein may occur to those of ordinary skill in the art without departing from the spirit and scope of the disclosed subject matter. Further, the various features of the embodiments described herein also can be combined, rearranged, or separated without departing from the spirit and scope of the disclosed subject matter. Accordingly, the invention is not to be defined only by the preceding illustrative description.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method of assembling a modular unit comprising at least a concrete column having an embedded steel receptacle with an opening at a proximal end and an opening at a distal end, and a concrete joist or slab having an embedded steel receptacle with an opening at a proximal end, the method comprising the steps of:

disposing the column on top of the joist or slab such that the proximal opening of the receptacle of the joist or slab and the distal opening of the receptacle of the column meet and the receptacle of the column and the receptacle of the joist or slab are aligned along the same longitudinal axis;

inserting a threaded steel rod through the proximal opening of the receptacle of the column and into the receptacle of the column and the receptacle of the joist or slab so that the threaded steel rod extends from the receptacle of the joist or slab through the proximal opening in the receptacle of the joist or slab and through the distal opening of the receptacle of the column and, the threaded rod having an outer diameter less than an inner diameter of the receptacle of the joist or slab and the receptacle of the column; and disposing grout in the receptacle of the joist or slab and the receptacle of the column to surround and secure the threaded steel rod and thereby form the modular unit, wherein the threaded rod has a notch disposed in a proximal end configured to engage a twisting means, such that actuating the twisting means applies torque to the threaded rod to thereby break up the grout, and wherein the column, the joist or slab, and the threaded steel rod are configured to separate apart from each other for at least one of reuse and recycling after actuation of the twisting means.

2. A method of assembling and disassembling a modular unit, the modular unit comprising at least a concrete column comprising an embedded steel receptacle having an opening at a proximal end and an opening at a distal end, and a concrete joist or slab comprising an embedded steel receptacle having an opening at a proximal end, the method comprising:

disposing the column on top of the joist or slab such that the proximal opening of the receptacle of the joist or slab and the distal opening of the receptacle of the column meet and the receptacle of the column and the receptacle of the joist or slab are aligned along the same longitudinal axis;

inserting a threaded steel rod through the proximal opening of the receptacle of the column and into the receptacle of the column and the receptacle of the joist or slab so that the threaded steel rod extends from the receptacle of the joist or slab through the proximal opening in the receptacle of the joist or slab and through the distal opening of the receptacle of the column, the threaded rod having an outer diameter less than an inner diameter of the receptacle of the joist or slab and the receptacle of the column, the threaded rod having a notch disposed in a proximal end;

disposing grout in the receptacle of the joist or slab and the receptacle of the column to surround and secure the threaded steel rod and thereby form the modular unit;

engaging a twisting means with the notch in the proximal end of the threaded steel rod;

actuating the twisting means to apply torque to the threaded rod to thereby break up the grout; and separating the column, the joist or slab, and the threaded steel rod apart from each other for at least one of reuse and recycling.

3. The method of claim 2, wherein the twisting means comprises a steel bar or an impact hammer drive.

4. A method of disassembling a modular unit comprising at least a concrete column having an embedded steel receptacle with an opening at a proximal end and an opening at a distal end, and a concrete joist or slab having an embedded steel receptacle with an opening at a proximal end, wherein: (i) the column is disposed on top of the joist or slab such that the proximal opening of the receptacle of the joist or slab and the distal opening of the receptacle of the column meet and the receptacle of the column and the receptacle of the joist or slab are aligned along the same longitudinal axis; (ii) a threaded steel rod is positioned in the receptacle of the column and the receptacle of the joist or slab so that the threaded steel rod extends from the receptacle of the joist or slab through the proximal opening in the receptacle of the joist or slab and through the distal opening of the receptacle of the column, the threaded rod having an outer diameter less than an inner diameter of the receptacle of the joist or slab and the receptacle of the column, the threaded rod having a notch disposed in a proximal end; and (iii) grout is disposed in the receptacle of the joist or slab and the receptacle of the column to surround and secure the threaded steel rod and thereby form the modular unit, the method comprising the steps of:

engaging a twisting means with the notch in the proximal end of the threaded steel rod;

actuating the twisting means to apply torque to the threaded rod to thereby break up the grout; and separating the column, the joist or slab, and the threaded steel rod apart from each other for at least one of reuse and recycling.

* * * * *